US006230617B1

(12) United States Patent
Mori

(10) Patent No.: US 6,230,617 B1
(45) Date of Patent: May 15, 2001

(54) PRINTER

(75) Inventor: Tomiya Mori, Kakuda (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/248,320

(22) Filed: Feb. 11, 1999

(30) Foreign Application Priority Data

Feb. 13, 1998 (JP) ..... 10-031688
Nov. 26, 1998 (JP) ..... 10-335859

(51) Int. Cl.[7] ..... B41C 1/14
(52) U.S. Cl. ..... 101/128.4; 101/116
(58) Field of Search ..... 101/116, 114, 101/128.4, 127.1, 121, 122, 129

(56) References Cited

U.S. PATENT DOCUMENTS 5,662,040 9/1997 Mori et al. .

FOREIGN PATENT DOCUMENTS 59-104937 6/1984 (JP) .
6-305232 11/1994 (JP) .
6-320852 11/1994 (JP) .
6-320853 11/1994 (JP) .

*Primary Examiner*—Ren Yan
(74) *Attorney, Agent, or Firm*—Oblon, Spivak, McClelland, Maier & Neustadt, P.C.

(57) ABSTRACT

A printer of the present invention is capable of stably conveying a perforated part of a stencil, or master, coming out of master making means to master clamping means mounted on an ink drum and surely handing it over to the master clamping means, and preventing the master from creasing during conveyance. Master holding means for holding the master is positioned upstream of, in a direction of master transport, cutting means used to cut the stencil at a preselected length.

48 Claims, 15 Drawing Sheets

PRINTER

BACKGROUND OF THE INVENTION

The present invention relates to a printer capable of stably conveying a stencil thermally perforable stencil to master clamping means mounted on an ink drum.

In a stencil printer, a stencil perforated or cut in accordance with image data, i.e., a master is wrapped around an ink drum that is rotated by a drive source. Ink is transferred from the ink drum to a paper or similar recording medium via the perforations of the master, forming an image on the paper. Master clamping means is openably mounted on the outer periphery of the ink drum for clamping the leading edge of the master. At a preselected clamping position, the master clamping means is caused to open and then close to clamp the leading edge of the master conveyed by a platen roller and rollers positioned upstream of the clamping means in a direction of stencil transport.

The stencil may have a laminate structure consisting of a thermoplastic resin film as thin as 2 $\mu$m to 9 $\mu$m and a porous support formed of Japanese paper, synthetic fibers, or a combination thereof. The porous support may be reduced in thickness or may even be omitted. Conveyance of such a stencil toward the master clamping means has some problems left unsolved, as follows.

(1) Because the stencil is so thin, it is apt to wrap around the platen roller or any other roller being driven before reaching the master clamping means due to, e.g., static electricity or curl.

(2) Even when the stencil is successfully conveyed without wrapping around any roller, it slightly waves due to thermal contraction during perforation or the curl of the film. Should the master clamping means clamp the waved stencil and wrap it around the ink drum, the master might crease on the ink drum and bring about defective printing. This is particularly true when the porous support is thin or when the thermoplastic resin film is used alone, i.e., when the stencil lacks in elasticity.

(3) A guide plate may be provided on a stencil transport path extending to the master clamping means. However, the guide plate must not adjoin the ink drum that is rotated or interfere with the ink drum or the master clamping means. Even the guide plate cannot avoid the defective conveyance of the stencil if the stencil lacks in elasticity and is electrostatically charged.

(4) It is a common practice to coat the surfaces of the stencil with an antistatic agent in order to protect the stencil from static electricity. A greater amount of antistatic agent is necessary for a stencil lacking in elasticity than for a stencil having elasticity. This brings about the corrosion of the thermal head and increases the cost of the stencil itself.

Although technologies capable of solving the above problems (1)–(4) have not been reported yet, Japanese Patent Laid-Open Publication Nos. 59-104937 and 6-320853, for example, each teaches master nipping means capable of nipping the leading edge of a master at a position downstream of cutting means and conveying it to master clamping means mounted on an ink drum. Japanese Patent Laid-Open Publication No. 6-305232 proposes an arrangement of the type conveying the leading edge of a stencil from a position upstream of cutting means to master clamping means while laying the stencil on a sheet member.

However, the master nipping means taught in the above Laid-Open Publication Nos. 59-104937 and 6-320853 each is positioned downstream of the cutting means. It follows that when the leading edge of the stencil from which the master has been cut off is conveyed to the master nipping means, the stencil is apt to wrap around a roller, jam the cutting means, or be caught by the inlet of the master nipping means. This prevents the leading edge of the stencil from being stably conveyed to master clamping means mounted on an ink drum.

The problem with the arrangement disclosed in Laid-Open Publication No. 6-305232 is that the stencil being conveyed together with the sheet member is apt to roll up away from the sheet member and crease before reaching master clamping means mounted on an ink drum. In addition, it is difficult to stably convey the stencil. Although the leading edge of the stencil may be adhered or otherwise connected to the sheet member in order to prevent it from rolling up, this kind of approach needs an extra mechanism and an extra step. Moreover, the stencil is likely to crease during adhesion or similar connection or fail to have its leading edge smoothly peeled off the sheet member when handed over to the master clamping means.

Technologies relating to the present invention are also disclosed in, e.g., Japanese Patent Laid-Open Publication No. 6-320852.

SUMMARY OF THE INVENTION

It is therefore an object of the present invention to provide a printer capable of stably conveying a stencil coming out of master making means to master clamping means mounted on an ink drum and handing it over to the master clamping means, while preventing the stencil from creasing during conveyance and thereby insuring desirable printing.

A printer of the present invention includes a porous rotatable ink drum having master clamping means for clamping the leading edge of a master in a part of its outer periphery. A master making section perforates a stencil in accordance with image data to thereby produce the master and conveys the master to be wrapped around the ink drum. A cutting section cuts the stencil perforated by the master making section a preselected length to thereby separate the master. A master holding device is positioned upstream of the cutting section in a direction of stencil transport for holding the master. The master holding device may hold the master before the cutting means cuts off the master.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the printer in accordance with the present invention will be described with reference to the accompanying drawings.

First Embodiment

Figure 1:
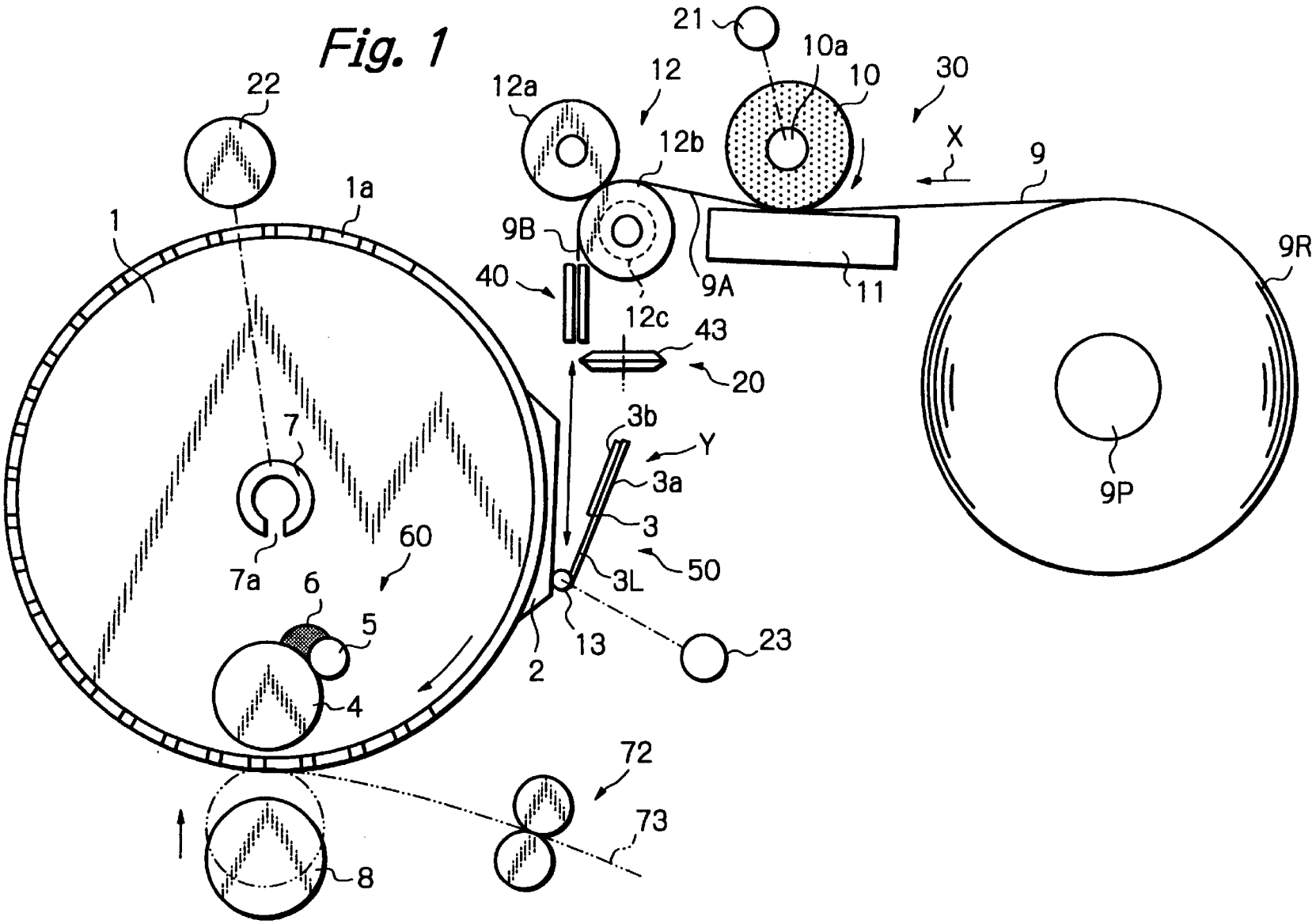
FIG. 1 shows the general construction of a first embodiment of the printer in accordance with the present invention.

Referring to FIG. 1, a printer embodying the present invention is shown and implemented as a stencil printer by way of example. As shown, the stencil printer includes a stencil 9 implemented as a roll 9R and capable of being perforated, or cut, by heat. Master making means 30 perforates the stencil 9 while conveying it. Master clamping means 50 is mounted on the outer periphery 1*a* of an ink drum 1. Master nipping and conveying means 40 is a specific form of master holding means for holding the stencil 9 and conveying it to the master clamping means 50. Cutting means 20 cuts off the part of the master 9 perforated by the master making means 30 at a preselected length to thereby produce a master 9A. Tension applying means 12 applies tension to the master 9 being conveyed toward the master clamping means 50. The roll 9R is positioned at the most upstream side in a direction X in which the stencil 9 is conveyed (stencil transport direction hereinafter). The ink drum 1 is positioned at the most downstream side in the stencil transport direction X. The master making means 30, tension applying means 12, master nipping and conveying means 40 and cutting means 20 are sequentially arranged in this order along a stencil transport path between the roll 9R and the ink drum 1.

The stencil 9 is implemented substantially only by a film of polyester or similar thermoplastic resin as thin as about 1 μm to 4 μm. The stencil 9 is wound round a tubular core 9P elongate in its axial direction, forming the roll 9R. The roll 9R is rotatably mounted to a frame or similar stationary member not shown. It is to be noted that the stencil 9 substantially implemented only by a thermoplastic resin film also refers to a thermoplastic resin film containing a trace of, e.g., antistatic agent and a thermoplastic resin film provided with one or more overcoat layers or similar thin layers on one or both sides thereof.

The master making means 30 includes a thermal head 11 and a platen roller 10. While the platen roller 10 presses the stencil 9 against the thermal head 11 and conveys it toward the ink drum 1, the head 11 perforates the stencil 9 in accordance with image data. The platen roller 10 is formed substantially integrally with a shaft 10*a* and extends in the axial direction of the shaft 10*a*. The shaft 10*a* is journalled to the opposite side walls of the printer not shown. An endless belt or similar drive transmitting means is passed over a pulley mounted on one end of the shaft 10*a* and a motor pulley. A stepping motor or drive source 21 causes the motor pulley to rotate and thereby causes the shaft 10*a* to rotate in a direction indicated by an arrow via the endless belt. The head 11 is positioned below the platen roller 10 and extends in parallel to the shaft 10*a*. The printer includes a document scanning section including an analog-to-digital converter and a control section for outputting digital image data, although not shown specifically. The head 11 has a number of heating elements, not shown, which are selectively energized in accordance with the digital image data to thereby perforate the stencil 9 by heat. Such a configuration and operation of the head 11 is conventional.

The ink drum 1 is made up of a porous hollow cylindrical support and a mesh screen wrapped around the support. The perforated stencil or master 9A is wrapped around the outer periphery 1*a* of the ink drum 1. The ink drum 1 is rotatable about an ink pipe 7 playing the role a rotary center shaft at the same time. A drive motor or drum drive source 22 causes the ink drum 1 to rotate via a drive transmission mechanism, not shown, in a direction indicated by an arrow in FIG. 1. An ink roller 4 is disposed in the ink drum 1 and rotatable in the same direction and in synchronism with the ink drum 1 for feeding ink to the inner periphery of the drum 1. A doctor roller 5 is positioned in parallel to the ink roller 4 and spaced by a small gap from the roller 4, forming an ink well 6 having a generally wedge-shaped cross-section. Holes 7*a* are formed in the ink pipe 7 for feeding ink to the ink well 6. The ink roller 4, doctor roller 5 and ink pipe 7 constitute ink feeding means 60 in combination. A press roller or pressing member 8 is positioned beneath the outer periphery 1*a* of the ink drum 1 and faces the ink roller 4. A moving mechanism, not shown, selectively moves the press roller 8 upward in order to press a paper or similar recording medium 73 against the ink drum 1. The press roller 8 may be replaced with a conventional press drum, if desired.

The outer periphery 1*a* of the ink drum 1 includes a non-porous portion on which the mater clamping means 50 for clamping the leading edge 9B of the master 9A is mounted. The master clamping means 50 is made up of a stage 2, a clamper 3, and a magnet 3*b*. The stage 2 extends in parallel to a line parallel to the axis of the ink drum 1 and is constructed substantially integrally with the outer periphery 1*a* of the ink drum 1. An opening and closing device, not shown, causes the clamper 3 to move toward and away from the stage 2 about a shaft 13. The magnet 3*b* is affixed to the clamper 3 in order to magnetically lock the clamper 3 to the stage 2. The opening and closing device includes a stepping motor or clamper drive means 23 and a conventional drive transmission mechanism not shown.

Figure 2:
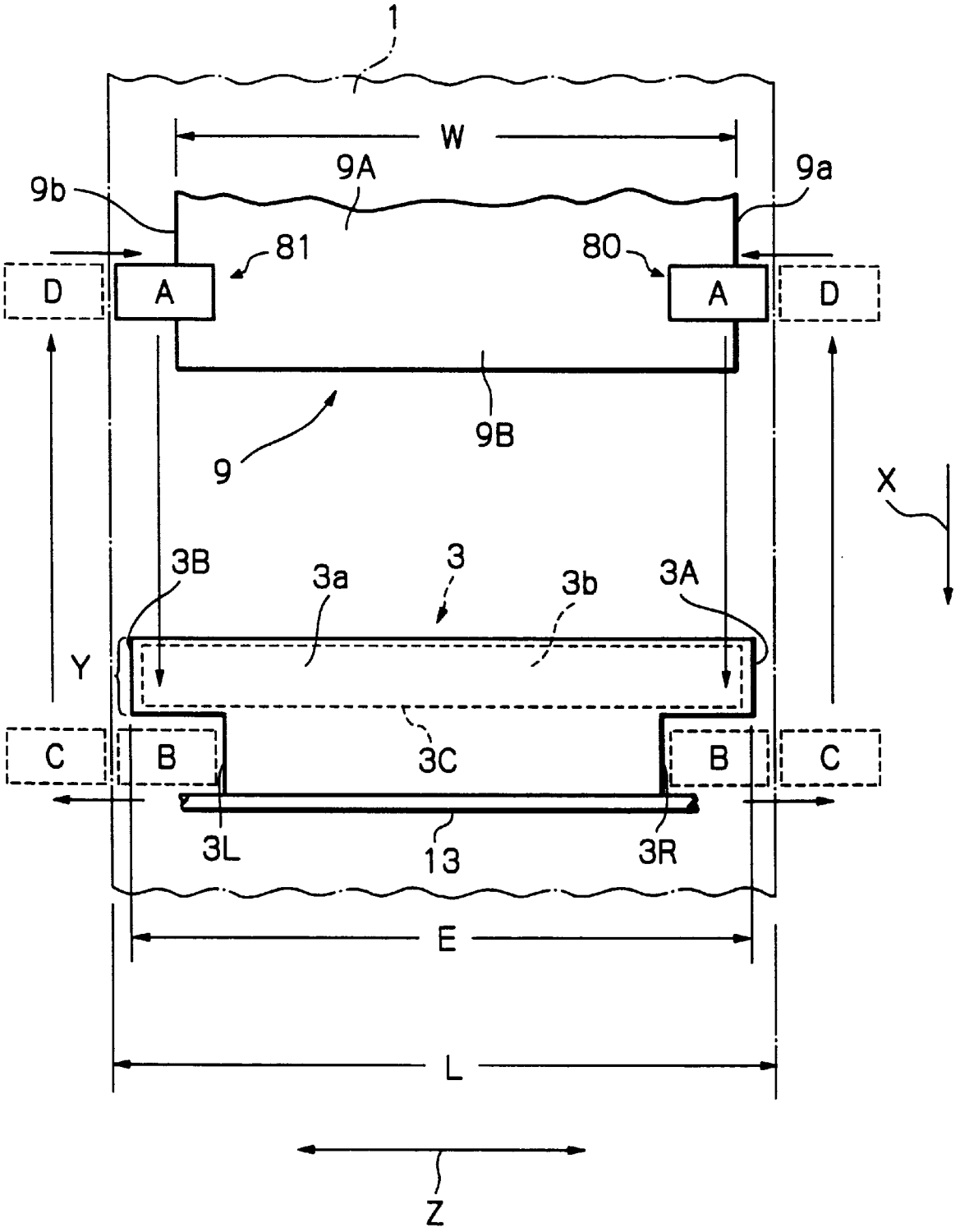
FIG. 2 is an enlarged plan view showing a first and a second position assigned to master holding means included in the first embodiment and operative positions and inoperative positions assigned to a pair of master holding portions also included in the embodiment.

As shown in FIG. 2, the clamper 3 extends in parallel to the line parallel to the axis of the ink drum 1. The width E of the clamper 3 is slightly greater than the width W of the stencil 9, but slightly smaller than the width L of the ink drum 1. The magnet 3*b* is positioned on the surface of the free edge 3*a* of the clamper 3 facing the stage 2 and positioned upstream of the shaft 13 in the stencil transport direction X. The clamper 3 has opposite side edges 3A and 3B in the widthwise direction of the stencil 9 indicated by a double headed arrow Z (widthwise direction Z hereinafter). The side edges 3A and 3B are positioned between the rear edge 3*c* of the magnet 3*b* and the shaft 13 and respectively formed with inwardly extending notches 3R and 3L. The region of the clamper 3 occupied by the magnet 3*b* will be referred to as a clamping portion Y hereinafter. The notches 3R and 3L prevent the clamper 3 from interfering with master nipping portions 80 and 81 included in the master nipping and conveying means 40. The master nipping portions 80 and 81 will be described in detail later.

Referring again to FIG. 1, the tension applying means 12 is located between the master making means 30 and the master nipping and conveying means 40 and implemented by a pair of roller members 12*a* and 12*b* contacting each other. The roller members 12*a* and 12*b* are so positioned as to steer the stencil 9 being substantially horizontally conveyed downward, as viewed in FIG. 1, by substantially 90 degrees. The roller members 12*a* and 12*b* are caused to rotate by the stencil 9 being conveyed. A torque limiter or similar brake device 12*c* is mounted on one end of the roller member 12*b*. The torque limiter 12*c* applies tension to the stencil 9 being conveyed in the stencil transport direction X, so that the stencil 19 is free from slackening in the direction X. Either one of the roller members 12*a* and 12*b* may be driven by an exclusive drive motor, not shown, if desired. In such a case, the peripheral speed of the roller member 12*a* or 12*b* to be driven should preferably be lower than the peripheral speed of the ink drum 1 or the moving speed of the master nipping and conveying means 40 in order to apply the tension to the stencil 9 more positively.

Figure 3:
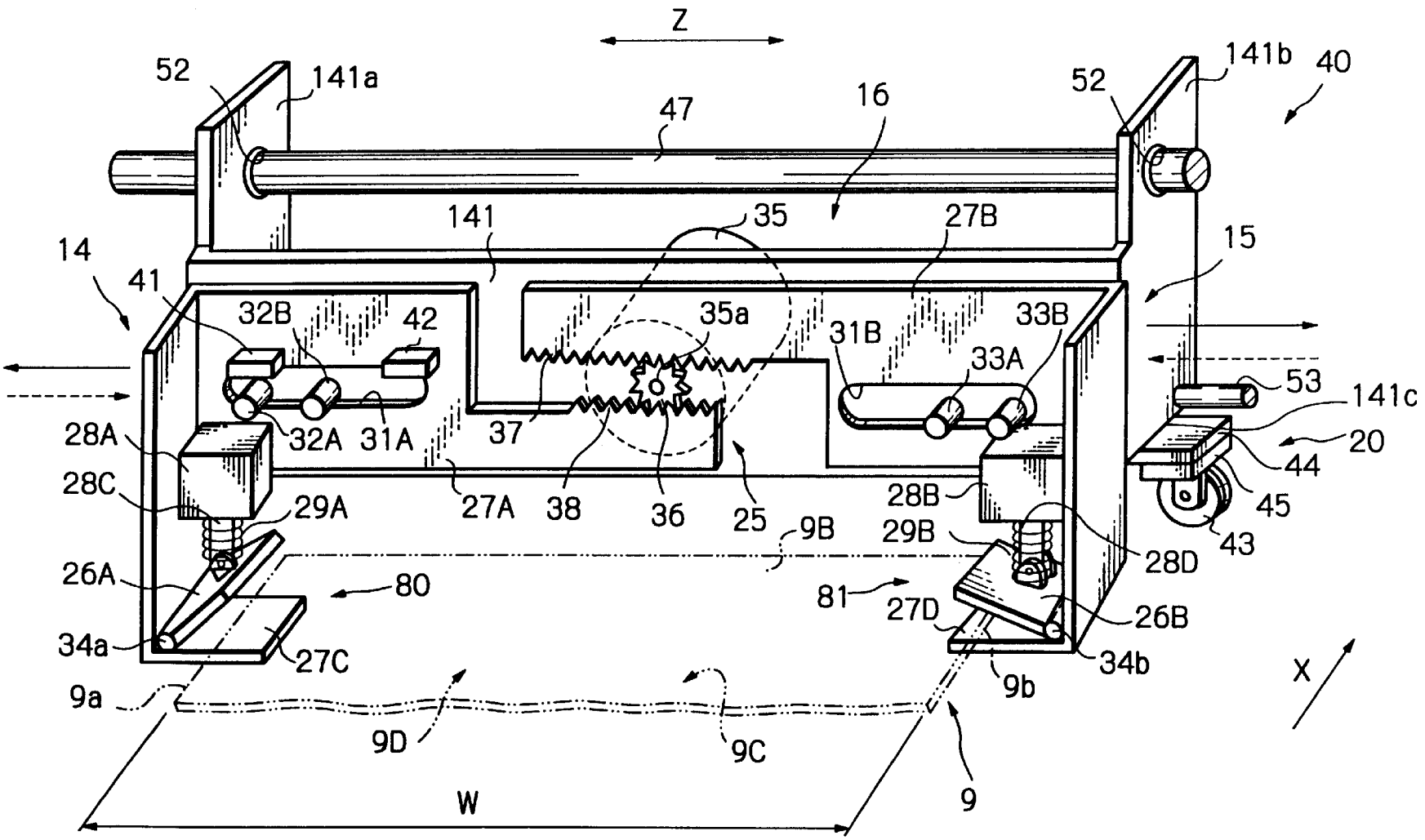
FIG. 3 is a perspective view showing master nipping and conveying means also included in the first embodiment as a specific form of master holding means.
Figure 4:
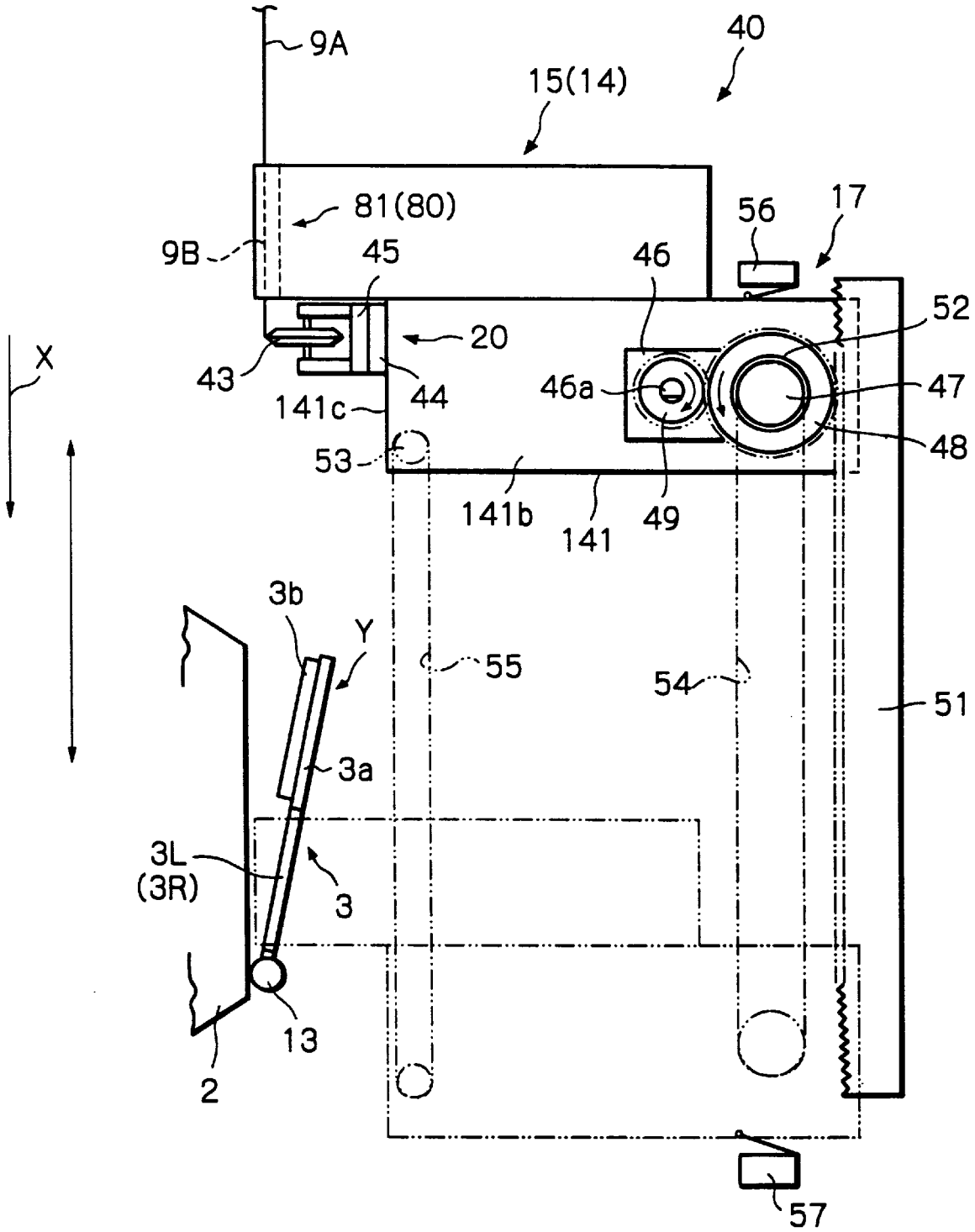
FIG. 4 is an enlarged view showing moving means included in the master nipping and conveying means.

The master nipping and conveying means 40 is positioned between the tension applying means 12 and the master clamping means 50 at the side upstream of the cutting means 20 in the stencil transport direction X. The master nipping and conveying means 40 nips the leading edge 9B of the stencil 9 and conveys it to the master clamping means 50. As shown in FIG. 3 specifically, the master nipping and conveying means 40 includes a pair of master holding portions 14 and 15 having the previously mentioned master nipping portions 80 and 81, respectively. The master nipping portions 80 and 81 respectively hold opposite side edges 9*a* and 9*b* of the leading edge 9B of the stencil 9 in the widthwise direction Z during the forward movement of the master nipping and conveying means 40. Displacing means 16 moves the master nipping portions 80 and 81 relative to each other in the widthwise direction Z. As shown in FIG. 4, moving means 17 causes the master nipping portions 80 and 81 to move back and forth between a first position and a second position indicated by a solid line and a dash-and-dots line, respectively. The cutting means 20, which will be described specifically later, is mounted on the portion of the master nipping and conveying means 40 downstream of the master nipping portions 80 and 81 in the stencil transport direction X.

As shown in FIG. 4, in the first position, the master nipping portions 80 and 81 are positioned upstream of the cutting means 20 in the stencil transport direction X and capable of nipping the leading edge of the stencil 9. In the second position, the master nipping portions 80 and 81 pass the leading edge 9B of the master 9A through the clamping portion Y of the clamper 3 and allow the clamping portion Y to clamp the edge 9B.

Figure 5:
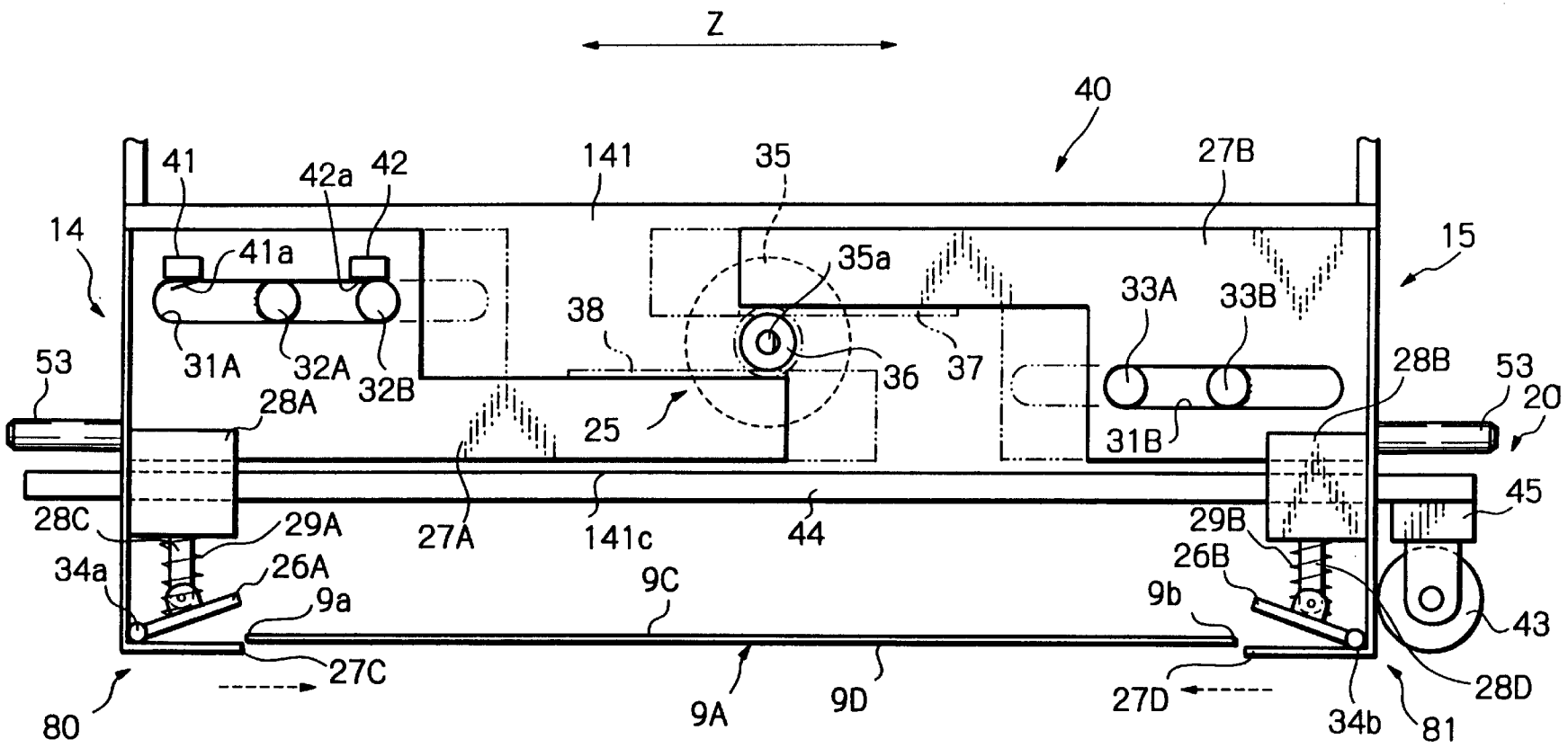
FIG. 5 is a front view showing a pair of master nipping portions included in the master nipping and conveying means, displacing means, and a drive mechanism assigned to the displacing means, together with drive members for driving the nipping portions.

As shown in FIG. 5, the master holding portions 14 and 15 respectively include upper clampers 26A and 26B and lower clampers 27A and 27B playing the role of master clamping members. The upper clampers 26A and 26B are openable and respectively clamp the edges 9*a* and 9*b* of the stencil 9 from both sides 9C and 9D when closed. Electromagnetic solenoids or nipping member drive means 28A and 28B open and close the upper clampers 26A and 26B, respectively. There a real so shown in FIG. 5 coiled compression springs 29A and 29B serving as biasing means The lower clampers 27A and 27B are implemented by flat plates mounted on a frame 141 included in the master nipping and conveying means 40, and each is slidable in the widthwise direction Z. Specifically, elongate slots 31A and 31B are formed in the lower clampers 27A and 27B, respectively. Stepped screws 32A and 32B and stepped screws 33A and 33B are studded on the frame 141 side by side in the widthwise direction Z and respectively movably received in the slots 31A and 31B. The lower clampers 27A and 27B each is bent in the direction substantially perpendicular to the widthwise direction Z, i.e., in the stencil transport direction X at one end and then bent inward in the direction Z at the lower end, as illustrated. The bent lower ends of the lower clampers 27A and 27B form contact portions 270 and 27D, respectively. The contact portions 27C and 27D are flush with each other and capable of contacting the back 9D of the stencil 9. The upper clampers 26A and 26B and contact portions 27C and 27D constitute the master holding portions 80 and 81, respectively.

The upper clampers 26A and 26B are respectively pivotable toward and away from the contact portions 27C and 27D about shafts 34*a* and 34*b*. The electromagnetic solenoids 28A and 28B are respectively mounted on the lower clampers 27A and 27B above the upper clampers 26A and 26B. Plungers 28C and 28D respectively protrude from the solenoids 28A and 28B and are respectively connected to the upper clampers 26A and 26B by respective pins. The solenoids 28A and 28B each pulls the respective plunger 28C or 28D when turned on, i.e., on receiving a drive signal. The compression springs 29A and 29B are respectively wound round the plungers 28C and 28D and have their opposite ends respectively anchored to the solenoids 28A and 28B and upper clampers 26A and 26B. The compression springs 29A and 29B therefore constantly bias the upper clampers 26A and 26B, respectively, in the closing direction.

The ends of the low clampers 27A and 27B remote from the ends adjoining the contact portions 270 and 27D, respectively, are implemented as a displacing means drive mechanism 25 which will be described later. Briefly, the mechanism 25 moves the master holding means 80 and 81 between operative positions (A or B, FIG. 2) for nipping the edges 9*a* and 9*b* of the stencil and inoperative positions (C or D, FIG. 2) retracted outward from the operative position. At the inoperative positions C or D, the master nipping portions 80 and 81 are respectively positioned outward of the side edges 3A and 3B of the clamper 3.

As shown in FIGS. 3 and 5, the displacing means drive mechanism 25 includes a reversible drive motor 35. A pinion gear 36 is mounted on the output shaft 35*a* of the drive motor 35. The lower clampers 27B and 27A are respectively formed with racks 37 and 38. The racks 37 and 38 are positioned at substantially the center of the frame 141 and held in mesh with the pinion gear 36 from both sides in the up-and-down direction. When the drive motor 35 rotates clockwise (forward), as viewed in FIG. 3, it causes the lower clampers 27A and 27B to move in directions indicated by solid arrows, entraining the master holding portions 80 and 81 to their inoperative positions. When the drive motor 35 rotates counterclockwise (reverse), as viewed in FIG. 3, it causes the clampers 27A and 27B to move in directions indicated by dashed arrows to their operative positions.

Sensors or sensing means 41 and 42 responsive to the above operative positions and inoperative positions, respectively, are mounted on the lower clamper 27A in the vicinity of the slot 31A. The sensors 41 and 42 each is implemented by a microswitch. As shown in FIG. 5, the sensor 42 responsive to the inoperative positions outputs a detection signal when its lever 42*a* is pressed by the stepped screw 32B. The sensor 41 responsive to the operative positions outputs a detection signal when its lever 41*a* is pressed by the stepped screw 32A.

Figure 8:
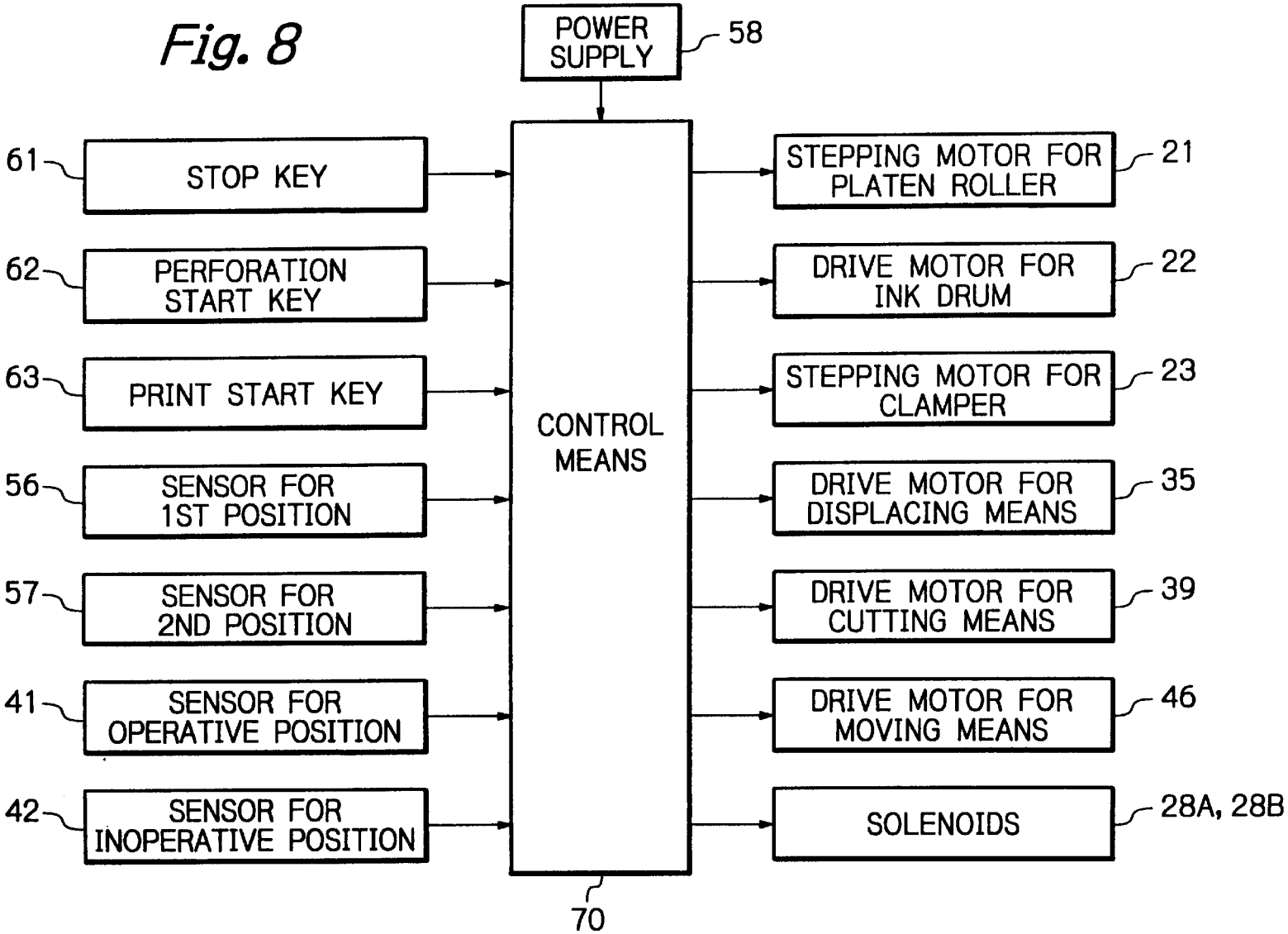
FIG. 8 is a block diagram schematically showing a control system included in the first embodiment.

As shown in FIGS. 3, 4 and 5, the cutting means 20 includes a rotary edge or cutting member 43 on the surface 141*c* of the frame 141 facing the stencil transport path. A rail 44 is affixed to the surface 141*c* and extends in the widthwise direction Z. The rotary edge 43 is mounted on a slider 45 slidably supported by the rail 44. A drive motor 39 shown only in FIG. 8 is assigned to the cutting means 20 and causes the slider 45 and therefore the edge 43 to move in the widthwise direction Z for cutting the stencil. Specifically, the edge 43 is mounted on the slider 45 such that its circumferential surface is positioned slightly below the contact portions 27C and 27D. The drive motor 29 is energized when the master nipping and conveying means 40 is held at its first position and when the time for cutting the stencil is reached. The master nipping and conveying means 40 therefore holds the stencil 9 before the cutting means 20 cuts off the perforated part of the stencil or master 9A. A cutting position assigned to the cutting means 20 refers to the position of the edge 43 associated with the first position of the master nipping and conveying means 40.

The cutting means 20 is mounted on the frame 141, as stated above. Therefore, when the master nipping and conveying means 40 moves back and forth between the first and second positions, the cutting means 20 moves together with the above means 40. It follows that the means 40 is capable of moving back and forth via the cutting position, and the positional relation between the edge 43 and the means 40 remains constant.

As shown in FIG. 4, the moving means 17 includes a rotary shaft 47 journalled to the frame 141, a gear 48 mounted on one end of the shaft 47, and a reversible drive motor 46 mounted on the frame 141. A drive gear 49 is mounted on the output shaft 46*a* of the drive motor 46. The drive gear 49 and a rack 51 are held in mesh with the gear 48 at both sides of the gear 48. As shown in FIG. 3, the shaft 47 is rotatably supported by opposite side walls 141*a* and 141*b* of the frame 141 via bearings 52 and extend outward of the side walls 141*a* and 141*b*. Two guide pins 53 are respectively studded on the side walls 141*a* and 141*b* and protrude outward in the widthwise direction Z.

As shown in FIG. 4, both ends of the shaft 47 and the guide pins 53 are respectively movably received in elongate slots 54 and 55 formed in a frame, not shown, included in the printer. The slots 54 and 55 extend away from the tension applying means 12 toward the master clamping means 50 held in a clamping position shown in FIG. 1. The slots 54 and 55 support the master nipping and conveying means 40 such that the means 40 is movable between a position just downstream of the tension applying means 12 and a position downstream of the clamping portion Y of the clamping means 50, i.e., between the first position and the second position stated earlier. The master nipping and conveying means 40 is therefore guided by the slots 54 and 55 up to the master clamping means 50 without shaking. The above clamping position refers to a position where the ink drum 1 stops when the master clamping means 50 clamps the leading edge 9B of the stencil 9. In the illustrative embodiment, at the clamping position, the clamper 3 is held in a substantially horizontal position and openable upward as viewed in FIG. 1.

The drive motor 46 rotates clockwise (forward), as viewed in FIG. 4, when the master nipping and conveying means 40 should be lowered from the first position to the second position. To lift the means 40 from the second position to the first position, the drive motor 46 rotates counterclockwise (reverse) as viewed in FIG. 4.

Sensors 56 and 57 responsive to the above first position and second position, respectively, are located in the vicinity of the master nipping and conveying means 40 and implemented by limit switches. When the means 40 is brought to the first position, the sensor 56 is actuated by a part of the frame 141 and outputs a detection signal. When the means 40 is brought to the second position, the sensor 57 is actuated by another part of the frame 141 and outputs a detection signal. In the illustrative embodiment, the means 40 is assumed to be in its home position when in the first position and when its nipping portions 80 and 81 are held at their operative positions.

In the illustrative embodiment, the master nipping and conveying means 40 is movable up and down in the substantially vertical direction, as viewed in FIG. 1. The rack 51 is affixed to a frame, not shown, in parallel to the slot 54. Therefore, when the drive motor 46 is not energized, the means 40 is held at a preselected position by the drive gear 49, gear 48 and rack 51 meshing with each other. In this sense, the rack 51 constitutes, in combination with the gear 48, stopping means for preventing the means 40 from dropping and positioning means.

Referring to FIG. 8, a control system included in the illustrative embodiment is shown and includes control means 70. The control means 70 includes a conventional microcomputer including a ROM (Read Only Memory) and a RAM (Random Access Memory) and plays the role of drivers for driving various means and the role of a controller. Electrically connected to the control means 70 are a stop key or stop commanding means 61, a perforation start key or perforation commanding means 62, a print start key or print commanding means 63, the sensors 56 and 57, the sensors 41 and 42, the stepping motors 21 and 23, the motors 22, 35, 39 and 46, the solenoids 28A and 28B, and a power supply 58.

When the perforation start key 62 is pressed for outputting a perforation command, the control means 70 causes the master nipping and conveying means 40 to convey the master 9A to the clamper 3 and causes the master 9A to be wrapped around the drum 1. Further, in response to a print command output from the print start key 63, the control means 70 causes a conventional printing procedure to be repeated a number of times corresponding to a desired number of printings input on numeral keys not shown. Moreover, when the stop key 61 is pressed, the control means 70 interrupts the master making operation and printing operation. In addition, the control means 70 controls the drive motor 39.

The operation of the illustrative embodiment, mainly the operation of the master nipping and conveying means 40, will be described hereinafter. In FIG. 1, the operator desiring to load the printer with a fresh stencil roll 9R presses a roll set key not shown. In response, the control means 70 determines whether or not the master nipping and conveying means 40 is held at its home position on the basis of the output of the sensor 56. If the answer of this decision is positive, then the control means 70 turns on the solenoids 28A and 28B in order to cause the upper clampers 26A and 26B to open. If otherwise, the control means 70 causes the master nipping and conveying means 40 to return to its home position.

The operator peels off the leading edge 9B of the stencil 9 from the roll 9R, passes the leading edge 9B between the platen roller 10 and the thermal head 11, and then passes it between the roller members 12*a* and 12*b* as far as the master nipping and conveying means 40. Subsequently, the operator again presses the roll set key. In response, the control means 70 turns off the solenoids 28A and 28B with the result that the master nipping portions 80 and 81 nip the sides edges 9*a* and 9*b* of the stencil 9 from both sides (front and back) 9C and 9D, as shown in FIG. 3.

Figure 6B:
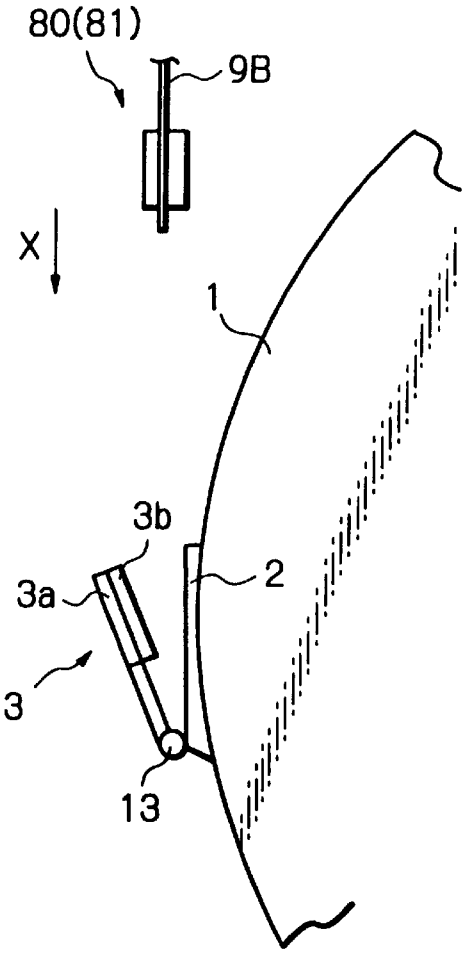
FIGS. 6A and 6B are respectively an enlarged plan view and a side elevation showing the master nipping portions held in operative positions at the first position.
Figure 6A:
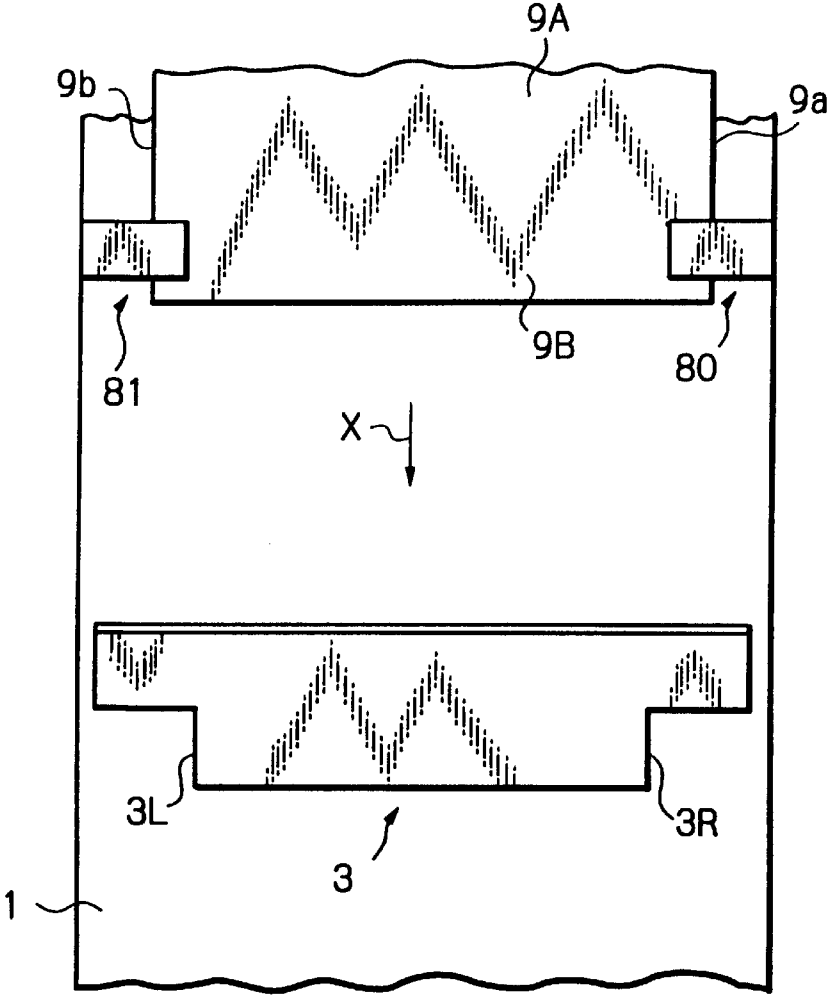

When the operator presses the perforation start key 62, the control means 70 causes the drive motor 22 to rotate by a preselected amount. As a result, a used master, not shown, existing on the ink drum 1 is removed by conventional discharging means not shown. The ink drum 1 is brought to a stop at the previously mentioned clamping position. Then, the control means 70 drives the stepping motor 23 in order to cause the clamper 3 to open at the clamping position, as shown in FIGS. 6A and 6B. The side edges 9*a* and 9*b* of the stencil 9 are held by the master nipping portions 80 and 81 at the first position assigned to the master nipping and conveying means 40.

In the above condition, the control means 70 drives the stepping motor 21 and thereby causes the platen roller 10 to rotate clockwise, as viewed in FIG. 1 for paying out the stencil 9. At the same time, the heating elements of the head 11 are selectively energized in accordance with digital image data. The head 11 therefore selectively perforates the part of the stencil 9 pressed against the head 11 by heat. The perforated part of the stencil or master 9A is conveyed by the platen roller 10 in the stencil transport direction X.

The control means 70 causes the drive motor 46, FIG. 4, to rotate clockwise in order to lower the master nipping and conveying means 40 toward the second position. At this instant, the means 40 moves at a speed substantially equal to the speed at which the platen roller 10 conveys the stencil 9. During this forward movement, the means 40 sequentially conveys the master 9A toward the clamper 3 while the roller members 12*a* and 12*b* constantly apply tension to the master 9A.

Figure 7B:
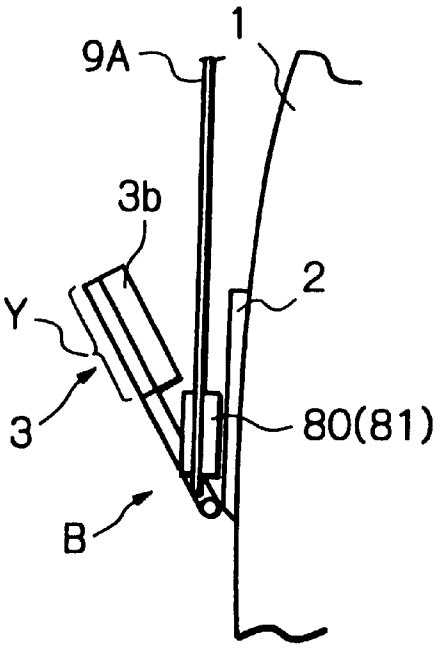
FIGS. 7A and 7B are respectively an enlarged plan view and a side elevation showing the master nipping portions held in operative positions at the second position.
Figure 7A:
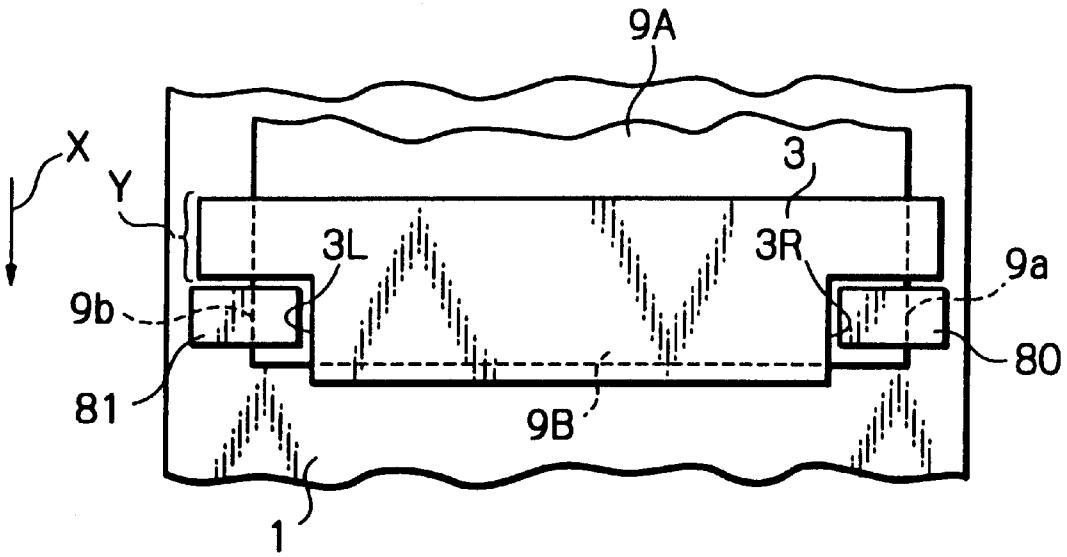

When the master nipping and conveying means 40 reaches the second position via the space between the stage 2 and the clamper 3, the sensor 57 detects it and sends a detection signal to the control means 70. In response, the control means 70 deenergizes the drive motor 46. As a result, as shown in FIGS. 7A and 7B, the master nipping portions 80 and 81 are brought to a stop in the notches 3R and 3L, respectively, by way of the clamping portion Y. Subsequently, the control means 70 drives the stepping motor 23 by a preselected amount in the closing direction and then energizes the solenoids 28A and 28B. Consequently, the leading edge 9B of the master 9A is clamped by the stage 2 and the magnet 3*b* and then released from the master nipping portions 80 and 81. Therefore, even when the master 9A is electrostatically charged or curled, it is surely conveyed to the clamper 3 without wrapping around the roller member 12*a* or 12*b*.

After turning on the solenoids 28A and 28B, the control means 70 causes the drive motor 35 to rotate clockwise, as viewed in FIG. 5, until the sensor 42 outputs a detection signal. Specifically, the drive motor 35 rotates the gear 36 clockwise with the result that the lower clampers 27A and 27B move away from each other from positions indicated by dash-and-dots lines to positions indicated by solid lines. When the stepped screw 32B presses the lever 42*a* of the sensor 42, the sensor 42 sends a detection signal to the control means 70. In response, the control means 70 stops driving the drive motor 35. The master nipping portions 80 and 81 are therefore moved to their inoperative positions at the second position assigned to the master nipping and conveying means 40.

In response to the detect ion signal output from the sensor 42, the control means 70 causes the drive motor 46, FIG. 4, to rotate counterclockwise until the sensor 56 responsive to the first position outputs a detection signal. Specifically, the drive motor 46 returns the master nipping and conveying means 40 from the second position indicated by dash-and-dots lines in FIG. 4 to the first position. In FIG. 2, the master nipping portions 80 and 81 held at the inoperative positions C at the second position are moved to the inoperative positions D associated with the first position. The master nipping portions 80 and 81 so remaining in the inoperative positions during return movement do not interfere with the side edges 9*a* and 9*b* of the master 9A or the side edges 3A and 3B of the clamper 3.

The stepping motor 21 is continuously driven even when the master nipping portions 80 and 81 are moved from the positions C toward the positions D, causing the platen roller 10 to continuously convey the stencil 9. Consequently, the stencil 9, or master 9A, is fed by an excess amount between the platen roller 10 and the roller members 12*a* and 12*b*.

In response to the detection signal output from the sensor 56, the control means 70 drives the drive motor 22 so as to rotate the ink drum1 in a direction indicated by an arrow in FIG. 1. As a result, the master 9A is wrapped around the ink drum 1.

If desired, the control means 70 may cause the ink drum 1 to start rotating when the master nipping portions 80 and 81 are moved to their inoperative positions at the second position of the master nipping and conveying means 40. In such a case, the means 40 will return toward the second position while the master 9A is sequentially wrapped around the ink drum 1.

When the stencil 9 is conveyed by a preselected amount by the preselected amount of rotation of the stepping motor 21, the control means 70 determines that the master 9A has been fully wrapped around the ink drum 1. Then, the control means 70 stops driving the stepping motor 21 and drive motor 22. Subsequently, the control means 70 causes the drive motor 35 to rotate counterclockwise, as viewed in FIG. 5, until the sensor 41 outputs a detection signal. Specifically, the drive motor 35 rotates the gear 36 counterclockwise and thereby moves the lower clampers 27A and 27B toward each other, as indicated by dashed arrows, via the racks 38 and 37. The master nipping portions 80 and 81 are therefore brought to their operative positions indicated by dash-and-dots lines. When the stepped screw 32A presses the lever 41*a* of the sensor 41, the sensor 41 sends a detection signal to the control means 70. In response, the control means 70 stops rotating the drive motor 35. Consequently, the master nipping portions 80 and 81 are held at the operative positions at the first position of the master nipping and conveying means 40.

In the above condition, the leading edge 9B of the non-perforated part of the stencil 9 is positioned in the vicinity of the master nipping portions 80 and 81. The control means 70 deenergizes the solenoids 28A and 28B in order to close the upper clampers 26A and 26B. As a result, the upper clampers 26A and 26B respectively nip the side edges 9*a* and 9*b* of the above stencil 9. Subsequently, the control means 70 drives the drive motor 39 for the cutting means 20. The drive motor 39 causes the slider 45 to slide from the right to the left, as viewed in FIG. 5, causing the rotary edge 43 to cut the trailing edge of the master 9A. In this manner, the master 9A is off cut with its leading edge 9B held by the clamper 3 and with its trailing edge just upstream of the cutting position held by the master nipping means 80 and 81. This not only insures accurate cutting of the master 9, but also makes it needless to convey the leading edge 9B of the non-perforated part of the stencil 9 to the master nipping portions 80 and 81 after the cutting operation. The stencil 9 therefore does not jam the path between the master making means 30 and the master nipping and conveying means 40 even when it is electrostatically charged or curled.

After the above cutting operation, the control means 70 causes the drive motor 22 to rotate the ink drum 1 in the direction indicated by an arrow in FIG. 1. At the same time, the control means 70 causes a paper feeder, not shown, to feed a single paper 73 toward a conventional registration roller 72 shown in FIG. 1. Further, the ink roller 4 is rotated in the same direction as the ink drum 1 while feeding ink to the inner periphery of the ink drum 1. The registration roller 72 drives the paper 73 toward a gap between the ink drum 1 and the press roller 8 at a preselected timing synchronous with the rotation of the ink drum 1. At this time, the press roller 8 spaced from the outer periphery 1*a* of the ink drum 1, as indicated by a solid line in FIG. 1, is brought into contact with the periphery 1*a* with the intermediary of the paper 73, as indicated by a dash-and-dots line in FIG. 1. The press roller 8 therefore presses the paper 73 against the master 9A wrapped around the ink drum 1. Consequently, the master 9A is caused to closely contact the periphery 1*a* with the ink oozing out via the perforations of the master 9A. Then, all the drive motors and stepping motors are deenergized in order to wait for a printing operation.

The operator causes the printer to produce a trial printing, inputs a desired number of printings on the numeral keys, and then presses the print start key 63. Then, the registration roller 72, as well as the ink drum 1 and press roller 8, is rotated in the above-described manner in order to produce the desired number of printings.

As stated above, in the illustrative embodiment, the stencil 9 is handed over from the master making means 30 to the master clamping means 50 by being retained by the master nipping means 80 and 81. This kind of scheme obviates defective conveyance particular to the conventional roller type scheme and ascribable to the static electricity, curl and so forth of the stencil 9. Further, the printer waits for the next master making operation with the master nipping portions 80 and 81 holding the leading edge 9B of the non-perforated stencil 9. The leading edge 9B is therefore prevented from slipping out of the master nipping portions 80 and 81 due to air streams caused by a fan or vibration. In addition, because the upper clampers 26A and 26B continuously hold the stencil 9 due to the action of the compression springs 29A and 29B, respectively, no problems occur when a power switch, not shown, provided on the printer is turned off and then turned on later for starting perforating the stencil 9. The leading edge 9B of the stencil 9 being conveyed under tension applied by the roller members 12*a* and 12*b* and brake device 12*c* is clamped by the clamper 3. This successfully prevents the master 9A from creasing or slackening when clamped by the clamper 3.

The master nipping and conveying means 40 is positioned upstream of the cutting means 20 in the stencil transport direction X, and the drive motor 39 is energized with the master nipping portions 80 and 81 holding the leading edge 9B of the stencil 9. Therefore, when the master 9A is cut off, the leading edge 9B of the non-perforated stencil 9 has already been located at the contact portions 27C and 27D of the lower clampers 27A and 27B. This makes it needless to convey the stencil 9 having been cut all the way to the master nipping and conveying means 40 and thereby prevents the stencil 9 from jamming the path between the master making means 30 and the master nipping and conveying means 40 or creasing due to a jam.

The master 9A is conveyed to the position downstream of the clamping portion Y of the camper 3 in the stencil transport direction X with its leading edge 9B retained by the master nipping portions 80 and 81. The leading edge 9B can therefore be surely clamped by the clamper 3.

Second Embodiment

A second embodiment of the printer in accordance with the present invention will be described with reference to FIG. 9. As shown, this embodiment is essentially similar to the first embodiment except for the configuration of the master holding means and the absence of displacing means 16 and displacing means drive mechanism 25. The structural elements identical with those of the first embodiment are designated by like reference numerals and will not be described specifically in order to avoid redundancy.

In this embodiment, the master holding means is implemented as master sucking and conveying means 140. The master sucking and conveying means 140 is positioned between the tension applying means 12 and the master clamping means 50 and upstream of the cutting means 20 in the stencil transport direction X. The means 140 conveys the leading edge 9B of the stencil 9 to the master clamping means 50 by sucking it with a pair of master holding portions 114 and 115. The cutting means 20 is mounted on a frame 141 (see FIGS. 10 and 11) included in the means 140 and positioned downstream of the master holding means 114 and 115 in the stencil transport direction X.

Figure 10:
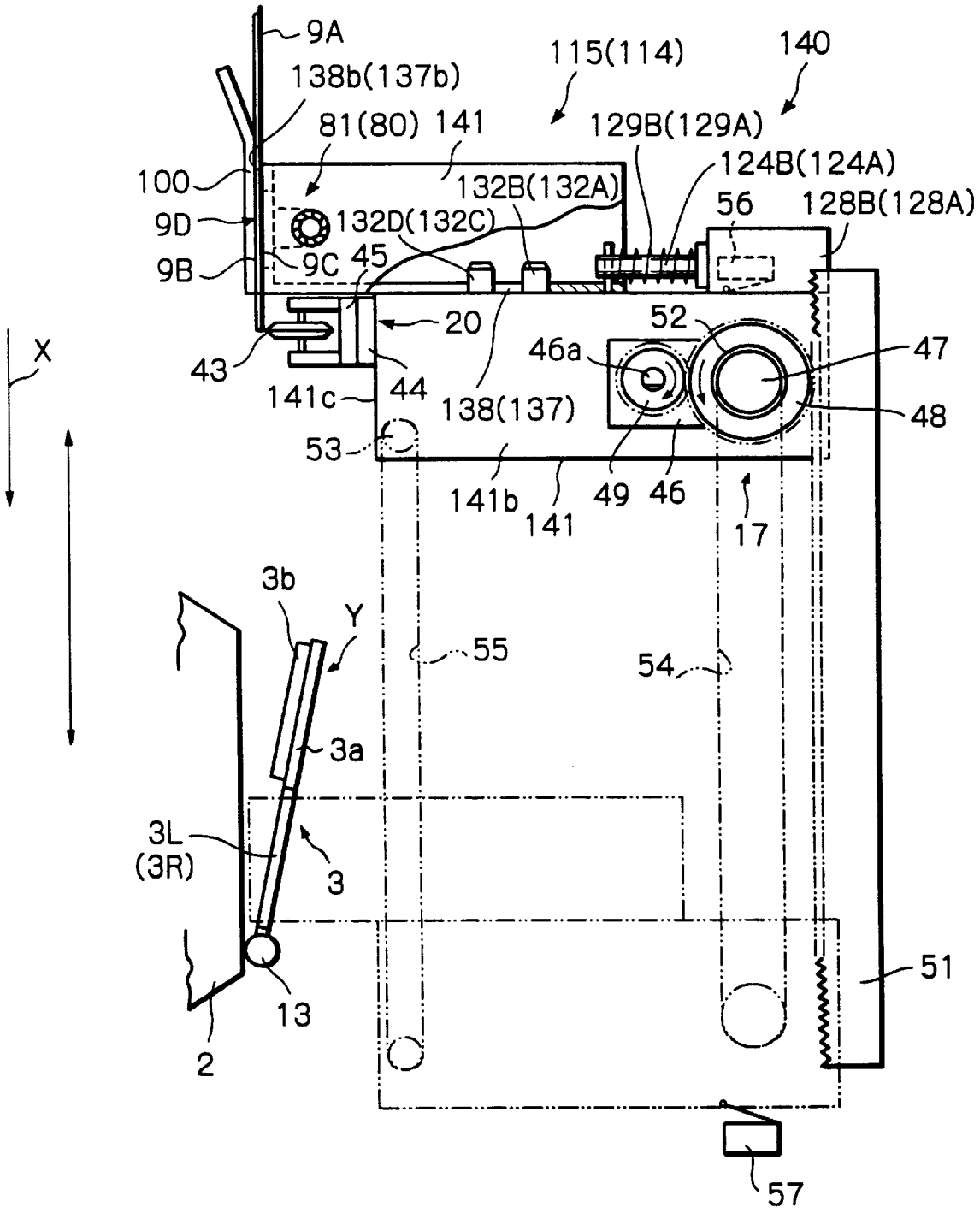
FIG. 10 is an enlarged view showing a first and a second position assigned to master holding means included in the second embodiment together with sucking portion drive means.

As shown in FIG. 10, the moving means 17 moves the master sucking and conveying means 140 back and forth between a first position and a second position indicated by a solid line and a dash-and-dots line, respectively. In the illustrative embodiment, the first position refers to a position where master sucking portions 137*b* and 138*b* to be described later are positioned upstream of the cutting means 20 in the stencil transport direction X so as to suck the leading edge 9B of the stencil 9. The second position refers to a position where the leading edge 9B of the master 9A is moved past the clamping portion Y of the clamper 3 and ready to be clamped by the clamping portion Y.

Figure 11:
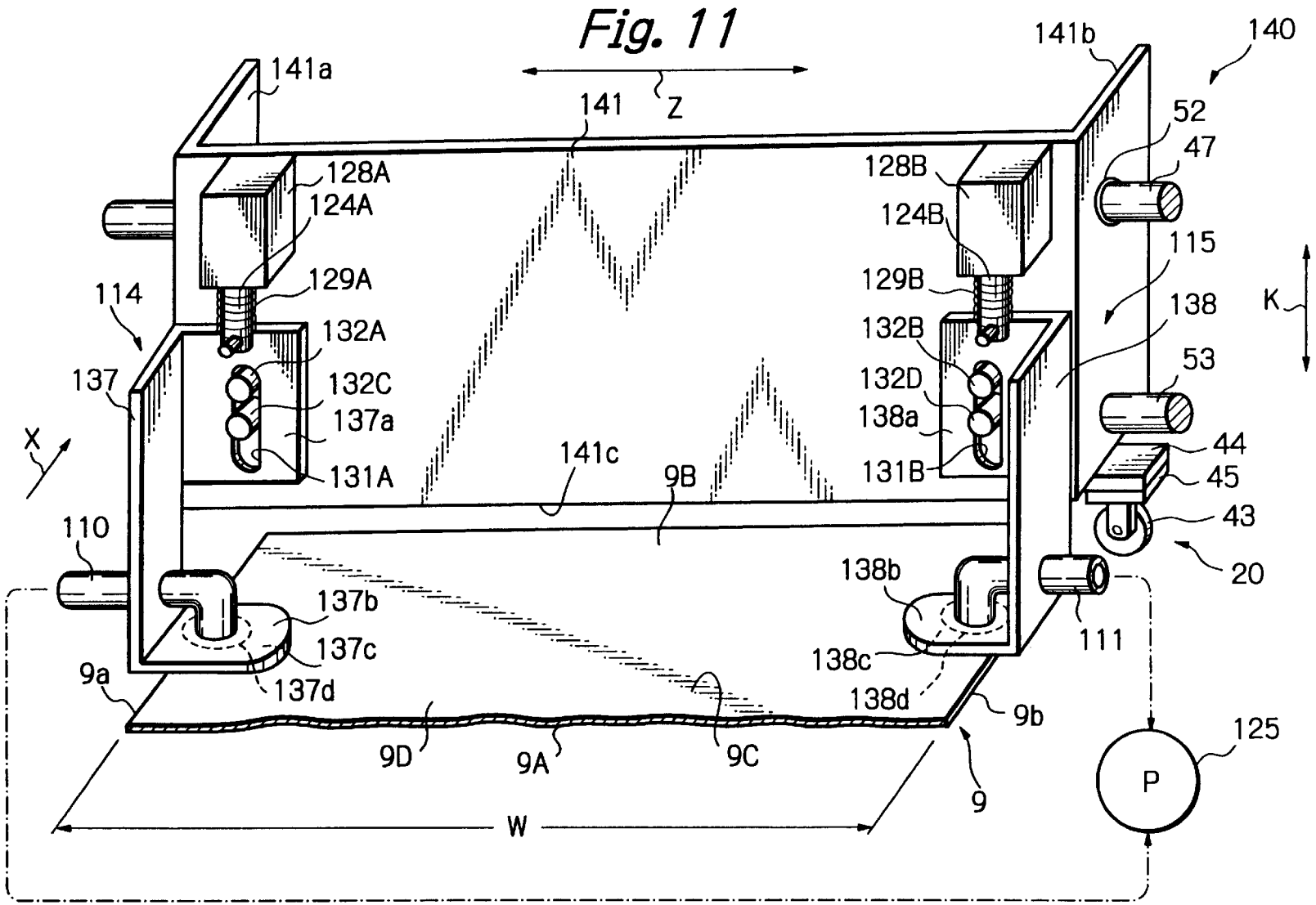
FIG. 11 is a perspective view showing master sucking and conveying means which is another specific form of the master holding means.

As shown in FIG. 11, the master holding portions 114 and 115 respectively suck, during forward movement, the opposite side edges 9*a* and 9*b* of the leading edge 9B of the stencil 9 at one side or front side 9C of the stencil 9. The master holding portion 114 has a suction frame 137, an electromagnetic solenoid or sucking portion drive means 128A for moving the frame 137 toward and away from the surface 90 of the master 9, and a coil spring or biasing means 129A. Likewise, the master holding portion 115 has a suction frame 138, an electromagnetic solenoid 128B, and a coil spring 129B. The two master holding portions 114 and 115 share a single vacuum pump or vacuum generating means 125.

The master sucking and conveying means 140 includes a frame 141. The suction frames 137 and 138 implemented by flat plates are mounted on the frame 141 in such a manner as to be movable toward and away from the surface 9C of the stencil 9, as indicated by a double-headed arrow K. Specifically, the suction frames 137 and 138 are respectively formed with slots 131A and 131B elongate in the above direction K in their upper portions 137*a* and 138*a*. Stepped screws 132A and 132C studded on the frame 141 are movably received in the slot 131A. Likewise, stepped screws 132B and 132D are studded on the frame 141 and movably received in the slot 131B. The direction K is perpendicular to the surface 9C of the stencil 9.

The suction frames 137 and 138 have their lower ends bent toward each other in the widthwise direction Z, forming sucking portions 137*b* and 138*b*. Suction holes 137*d* and 138*d* are respectively formed in the bent ends of the suction frames 137 and 138. A flexible pipe 110 is connected at one end to the vacuum pump 125 and at the other end to the suction hole 137*d*. A flexible pipe 111 is connected at one end to the vacuum pump 125 and at the other end to the suction hole 138*d*. The underside of the sucking portion 137*b* and that of the sucking portion 138*b* serve as suction surfaces 137*c* and 138*c* flush with each other and capable of contacting the surface 9C of the stencil 9.

The solenoids 128A and 128B are mounted on the frame 141 above the suction frames 137 and 138, respectively. The solenoid 128A and 128B have plungers 124A and 124B, respectively. The plungers 124A and 124B are respectively connected to the upper portions 137*a* and 138*a* of the suction frames 137 and 138 by pins. The solenoids 128A and 128B each pulls the respective plunger l24A or 124B when energized. The coil springs 129A and 129B are respectively wound round the plungers 124A and 124B, and each constantly biases the associated master sucking portion 137*b* or 138*b* toward the surface 9C of the stencil 9.

As shown in FIG. 10, a backup plate 100 is mounted on the printer body, not shown, such that it faces the master sucking portions 137*b* and 138*b* when the master sucking and conveying means 140 is located at the first position. When the means 140 is located at the first position, coil springs 129A and 129B respectively press the master sucking portions 137*b* and 138*b* against the backup plate 100.

Figure 12:
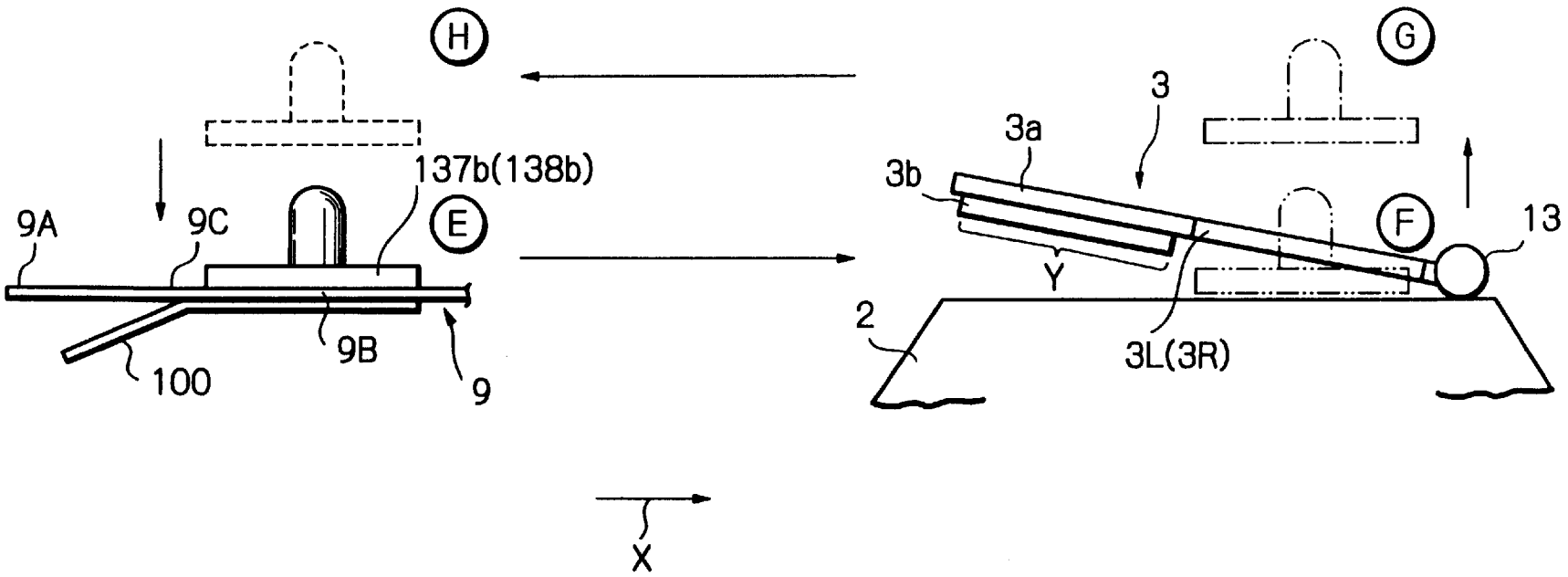
FIG. 12 is a side elevation showing operative positions and inoperative positions assigned to a pair of master sucking portions included in the master sucking and conveying means.

Usually, as shown in FIG. 12, the master sucking portions 137*b* and 138*b* each is located at an operative position, or holding position, E or F for sucking and holding the surface 9*c* of the leading edge 9B of the stencil 9. When the solenoids 128 A and 128B are energized, the master sucking portions 137*b* and 138*b* each is moved away from the surface 9C to an inoperative position G or H. In the illustrative embodiment, the inoperative position refers to a position remote from the clamper 3 held in its open position in the opening direction of the clamper 3. More specifically, the master sucking portions 137*b* and 138*b* held in their inoperative positions do not interfere with the edge 3*a* of the opened clamper 3 when the portions 137*b* and 138*b* move between the first and second positions. In the illustrative embodiment, the inoperative positions are defined above the edge 3*a* of the clamper 3, as shown in FIG. 12.

As shown in FIG. 10, the sensors 56 and 57 responsive to the above first position and second position, respectively, are located in the vicinity of the master sucking and conveying means 140 and implemented by limit switches. The means 140 is assumed to be in its home position when in the first position and when its master sucking portions 137*b* and 138*b* are held at their operative or sucking positions.

Figure 13:
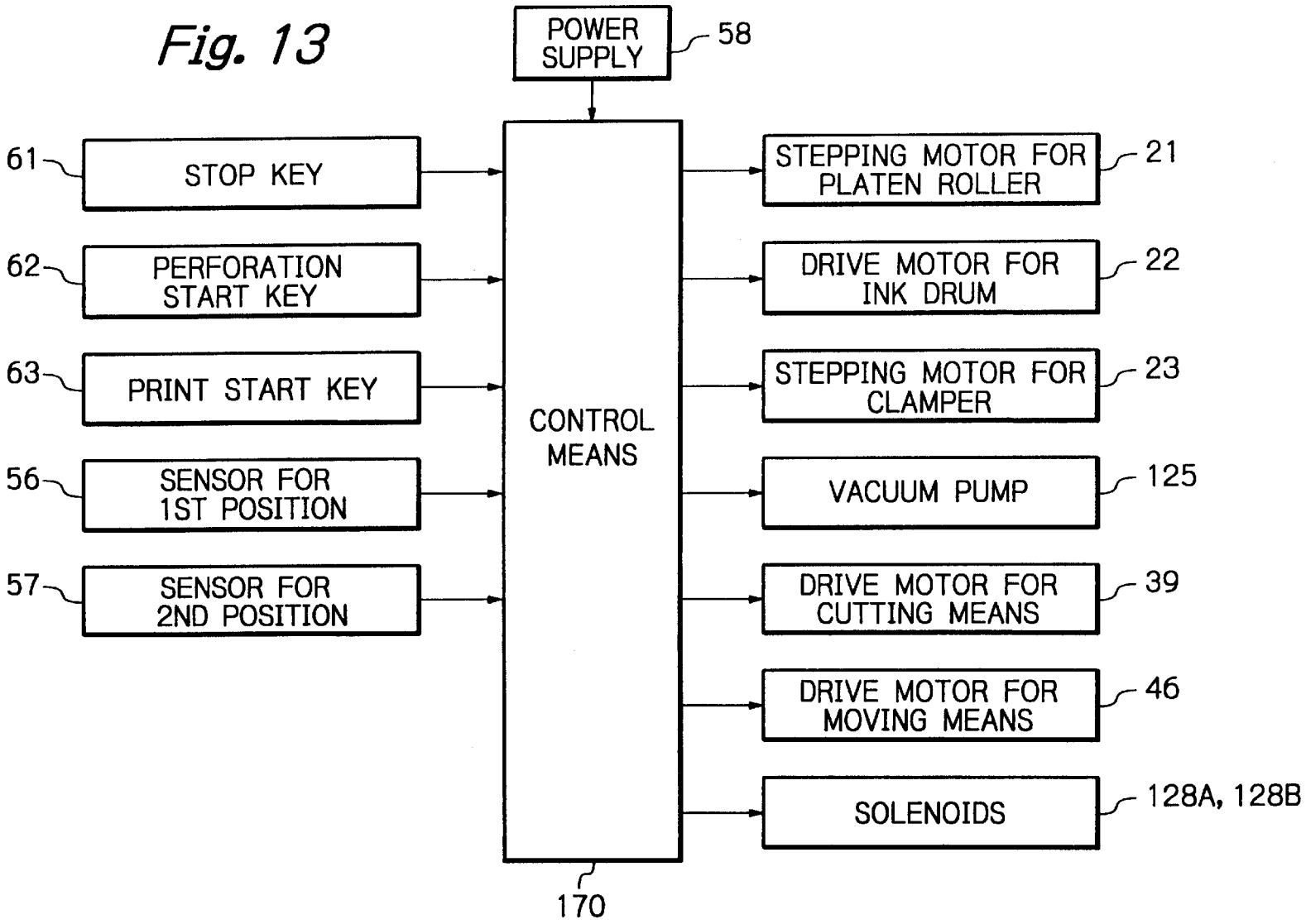
FIG. 13 is a block diagram schematically showing a control system included in the second embodiment.

FIG. 13 shows a control system included in the illustrative embodiment. As shown, the control system includes control means 170. The control means 170 includes a conventional microcomputer including a ROM and a RAM and plays the role of drivers for driving various means and the role of a controller. Electrically connected to the control means 170 are the stop key 61, perforation start key 62, print start key 63, sensors 56 and 57, stepping motors 21 and 23, motors 22, 39 and 46, vacuum pump 125, solenoids 128A and 128B, and power supply 58.

When the perforation start key 62 is pressed for outputting a perforation command, the control means 170 causes the master sucking and conveying means 140 to convey the master 9A to the clamper 3 of the ink drum 1 and causes the master 9A to be wrapped around the drum 1. Further, in response to a print command output from the print start key 63, the control means 170 causes a conventional printing procedure to be repeated a number of times corresponding to a desired number of printings input on the numeral keys not shown. Moreover, when the stop key 61 is pressed, the control means 170 interrupts the master making operation and printing operation. In addition, the control means 170 controls the drive motor 39.

The operation of the illustrative embodiment, mainly the operation of the master sucking and conveying means 140, will be described hereinafter. In FIG. 9, the operator desiring to load the printer with a fresh stencil roll 9R presses the roll set key not shown. In response, the control means 170 determines whether or not the master sucking and conveying means 140 is held at its home position on the basis of the output of the sensor 56. If the answer of this decision is positive, then the control means 170 turns on the solenoids 128A and 128B in order to cause the upper portion 137*a* and 138*a* to open. If otherwise, the control means 170 causes the master sucking and conveying means 140 to return to the home position.

The operator peels off the leading edge 9B of the stencil 9 from the roll 9R, passes the leading edge 9B between the platen roller 10 and the thermal head 11, and then passes it between the roller members 12*a* and 12*b* as far as the master sucking and conveying means 140. Subsequently, the operator again presses the roll set key. In response, the control means 170 turns off the solenoids 128A and 128B with the result that the master sucking portions 137*b* and 138*b* and backup plate 100 nip the side edges 9*a* and 9*b* of the stencil 9 from both sides (front and back) 9C and 9D, as shown in FIG. 10.

When the operator presses the perforation start key 62, the control means 170 causes the drive motor 22 to rotate by a preselected amount. As a result, a used master, not shown, existing on the ink drum 1 is removed by conventional discharging means, not shown. The ink drum 1 is brought to a stop at the previously mentioned clamping position. Then, the control means 170 drives the stepping motor 23 in order to cause the clamper 3 to open at the clamping position. At this instant, the vacuum pump 125 is operated, so that the side edges 9*a* and 9*b* of the stencil 9 are held by the master sucking portions 137*b* and 138*b* at the first position, as shown in FIG. 10.

Figure 9:
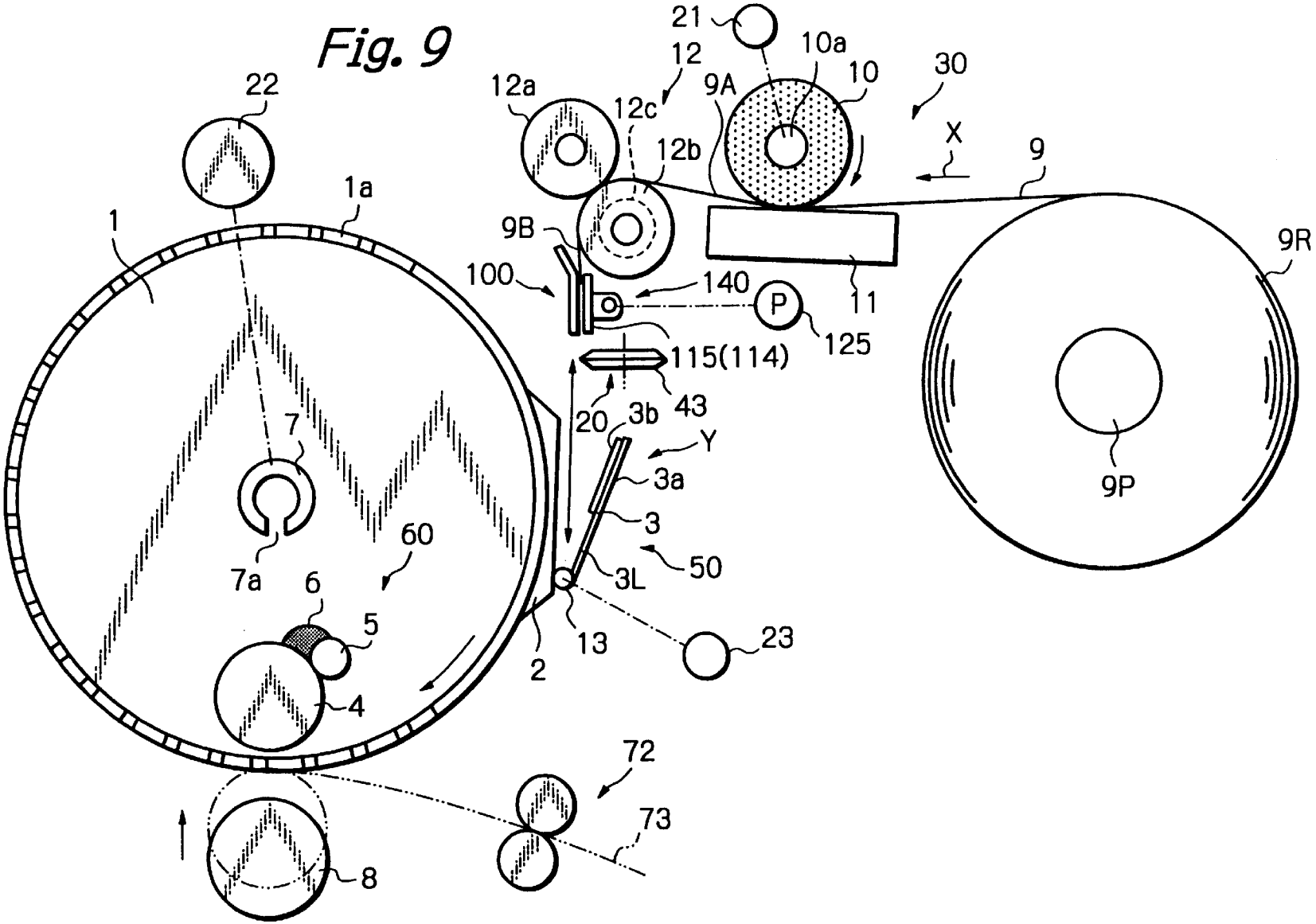
FIG. 9 shows the general construction of a second embodiment of the present invention.

In the above condition, the control means 170 drives the step motor 21 in order to cause the platen roller 10 to rotate clockwise, as viewed in FIG. 9, for paying out the stencil 9. At the same time, the heating elements of the thermal head 11 are selectively energized in accordance with digital image data, as in the first embodiment. The head 11 selectively perforates the part of the stencil 9 pressed against the head 11 by heat. The perforated part of the stencil or master 9A is conveyed by the platen roller 10 in the stencil transport direction X.

The control means 170 causes the drive motor 46, FIG. 10, to rotate clockwise in order to lower the master sucking and conveying means 140 toward the second position. At this instant, the means 140 moves at a speed substantially equal to the speed at which the platen roller 10 conveys the stencil 9. During this forward movement, the means 140 sequentially conveys the master 9A toward the clamper 3 while the roller members 12*a* and 12*b* constantly apply tension to the master 9A.

When the master sucking and conveying means 140 reaches the second position past the stage 2 and clamper 3 held open, the sensor 57 detects it and sends a detection signal to the control means 170. In response, the control means 170 deenergizes the drive motor 46. As a result, as shown in FIG. 12, the master sucking portions 137*b* and 138*b* are brought to a stop in the notches 3R and 3L, respectively, by way of the clamping portion Y, as indicated by F in FIG. 12. Subsequently, the control means 170 drives the stepping motor 23 by a preselected amount in the closing direction, turns off the vacuum pump 125, and then energizes the solenoids 128A and 128B. Consequently, the leading edge 9B of the master 9A is clamped by the stage 2 and the magnet 3*b* of the clamper 3. Thereafter, the master sucking portions 137*b* and 138*b* are moved to the inoperative positions G, FIG. 12, where suction does not act on the master 9A. Therefore, even when the master 9A is electrostatically charged or curled, it is surely conveyed to the clamper 3 without wrapping around the roller member 12*a* or 12*b*.

After turning on the solenoids 128A and 128B, the control means 170 causes the drive motor 46, FIG. 10, to rotate counterclockwise until the sensor 56 responsive to the first position outputs a detection signal. Specifically, the drive motor 46 returns the master sucking and conveying means 140 from the second position indicated by dash-and-dots lines in FIG. 10 to the first position. In FIG. 12, the master sucking portions 137*b* and 138*b* held at the inoperative positions G assigned to the second position are moved to the inoperative positions H assigned to the first position. The master sucking portions 137*b* and 138*b* so remaining in the inoperative positions during return movement do not interfere with the side edges 9*a* and 9*b* of the master 9A or the side edges 3A and 3B of the clamper 3.

The stepping motor 21 is continuously driven even when the master sucking portions 137*b* and 138*b* are moved from the positions G toward the positions H, causing the platen roller 10 to continuously convey the stencil 9. Consequently, the stencil 9, or master 9A, is fed by an excess amount between the platen roller 10 and the roller members 12*a* and 12*b*.

In response to the detection signal output from the sensor 56, the control means 170 drives the drive motor 22 so as to rotate the ink drum 1 in a direction indicated by an arrow in FIG. 9. As a result, the master 9A is wrapped around the ink drum 1.

If desired, the control means 170 may cause the ink drum 1 to start rotating when the master sucking portions 137*b* and 138*b* are moved to their inoperative positions at the second position of the master sucking and conveying means 140. In such a case, the means 140 will return toward the first position while the master 9A is sequentially wrapped around the ink drum 1.

When the stencil 9 is conveyed by a preselected amount by the preselected amount of rotation of the stepping motor 21, the control means 170 determines that the master 9A has been fully wrapped around the ink drum 1. Then, the control means 170 stops driving the stepping motor 21 and drive motor 22 and deenergizes the solenoids 128A and 128B, so that the master sucking portions 137*b* and 138*b* are returned form the inoperative positions H to the operative positions (home positions) E. At this instant, the leading edge 9B of the non-perforated part of the stencil 9 has already been positioned in the vicinity of the master sucking portions 137*b* and 138*b*.

After turning off the solenoids 128A and 128B, the control means 170 turns on the vacuum pump 125 and energizes the drive motor 39. As a result, the drive motor 39 causes the slider 45 to slide from the right to the left, as viewed in FIG. 11, causing the rotary edge 43 to cut the trailing edge of the master 9A. In this manner, the master 9A is cut off with its leading edge 9B held by the clamper 3 and with its trailing edge just upstream of the cutting position held by the master sucking means 137*b* and 138*b* and backup plate 100, while being sucked by the sucking portions 137*b* and 138*b*. This not only insures accurate cutting of the master 9, but also makes it needless to convey the leading edge 9B of the non-perforated part of the stencil 9 to the master sucking portions 137*b* and 138*b* after the cutting operation. The stencil 9 therefore does not jam the path between the master making means 30 and the master sucking and conveying means 140 even when it is electrostatically charged or curled. Thereafter, the operation for causing the master 9A to closely contact the ink drum 1 and producing printings is executed, as in the previous embodiment.

As stated above, in this embodiment, the master sucking portions 137*b* and 138*b* suck and convey the leading edge 9B of the master 9A to the master clamping means 50. This is contrastive to the nipping scheme of the previous embodiment and makes it needless for the master sucking portions 137*b* and 138*b* to move away from each other in the widthwise direction Z at the second position. This is why the illustrative embodiment does not include the displacing means 16 and displacing means drive mechanism 25. The illustrative embodiment therefore has a compact configuration and noticeably reduces the number of parts and cost, compared to the first embodiment. If desired, the vacuum pump 125 may be mounted on the frame 141 from the space efficiency standpoint. However, the vacuum pump 125 mounted on the frame 141 would increase the weight of the master sucking and conveying means 140 and therefore the load on the moving means 17. When priority is given to conveyance, the vacuum pump 125 should preferably be mounted on the frame of the printer body and connected by a flexible tubing resistive to pressure.

Further, the suction exerted by the suction pump 125 may be replaced with, e.g., two-sided adhesive tapes fitted on the bottoms of the master sucking portions 137*b* and 138*b*, in which case the master 9A will be retained by an adhesive force. Alternatively, static electricity may be generated on the bottoms 137*c* and 138*c* of the master sucking portions 137*b* and 138*b* for retaining the leading edge 9B of the master 9A.

Third Embodiment

Figure 14:
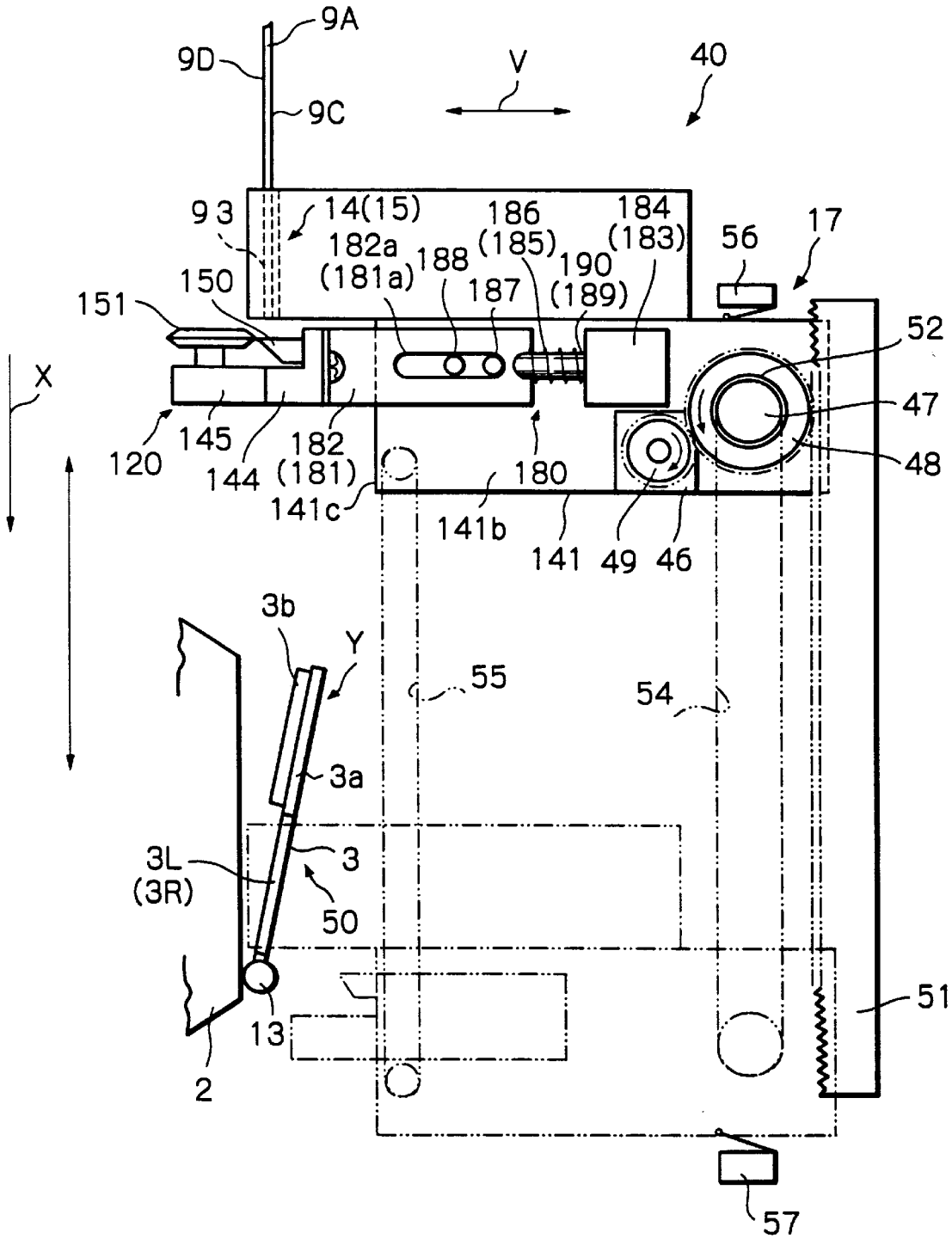
FIG. 14 is an enlarged view showing cutting means and cutting means moving means representative of a third embodiment of the present invention together with a non-interfering position assigned to the cutting means.

As shown in FIG. 14, a third embodiment of the present invention is essentially similar to the first embodiment except that cutting means 120 is substituted for the cutting means 20, and that cutting means moving means 180 is additionally provided. The cutting means 120 includes a stationary edge 150 and a circular rotary edge 151. When the cutting means 120 approaches the master clamping means 50, the cutting means moving means 180 moves the cutting means 120 to a position where the cutting means 120 does not interfere with the master clamping means 50. The cutting means 120 and cutting means moving means 180 are mounted on the frame 141. The structural elements of this embodiment identical with those of the first embodiment are designated by like reference numerals and will not be described specifically in order to avoid redundancy.

Figure 15:
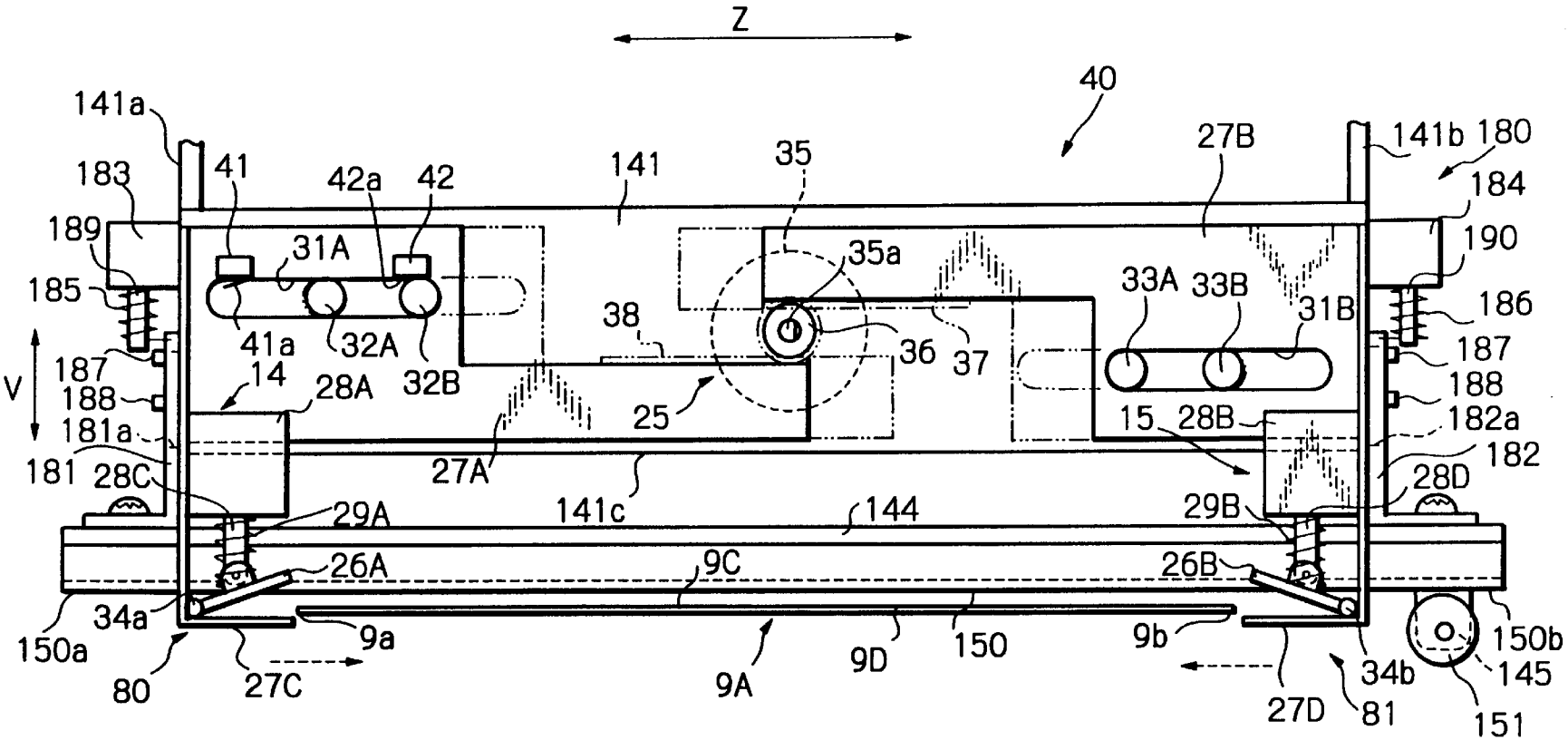
FIG. 15 is a front view of the cutting means and cutting means moving means shown in FIG. 14.

Specifically, the cutting means 120 is mounted on the frame 141 of the master nipping and conveying means 40 positioned downstream of the master nipping portions 80 and 81 in the stencil transport direction X. As shown in FIGS. 14 and 15, the stationary edge 150 of the cutting means 120 is affixed to a guide rail 144. A slider 145 is supported by the guide rail 144. The rotary edge 151 is mounted on the slider 145 and faces the stationary edge 150. As shown in FIG. 15, the guide rail 144 extends in the widthwise direction Z and connected to the side walls 141*a* and 141*b* of the frame 141 via brackets 181 and 182. The stationary edge 150 also extends in the widthwise direction Z such that opposite ends 150*a* and 150*b* thereof are respectively located outside of the side edges 9*a* and 9*b* of the master 9A.

As shown in FIG. 15, the motor 39, not shown, causes the slider 145 and therefore rotary edge 151 to move in the widthwise direction Z. The slider 145 has a home position outside of the side edges 9*a* and 9*b* of the master 9A, ideally outside of the side edges of the clamper 3 (see FIG. 2), and where the rotary edge 151 does not contact the master 9A or the clamper 3 during the movement of the master nipping and conveying means 40. The stationary edge 150 and rotary edge 151 respectively adjoin the front 90 and back 9D of the stencil 9 so as to nip the master 9A. The control means 70, FIG. 8, drives the drive motor 39 at the time for cutting off the master 9A.

The cutting means moving means 180 includes generally L-shaped brackets 181 and 182. Electromagnetic solenoids or drive means 183 and 184 respectively move the brackets 181 and 182 between operative positions for cutting off the maser 9A and inoperative positions not interfering with the clamper 3 held in its open position. Coil springs or biasing means 185 and 186 respectively constantly bias the brackets 181 and 182 toward the above operative positions.

Slots 181*a* and 182*a* elongate in a direction indicated by a double-headed arrow V, i.e., in a retracting direction are respectively formed in the longer portions of the L-shaped brackets 181 and 182. The shorter portions of the brackets 181 and 182 are directed toward the outside of the side walls 141*a* and 141*b*, respectively. A pair of pins 187 and 188 are studded on each of the brackets 181 and 182 and movably received in associated one of the slots 181*a* and 182*a*. In this configuration, the brackets 181 and 182 are slidably supported by the side walls 141*a* and 141*b*, respectively.

The solenoids 183 and 184 respectively have plungers 189 and 190, which are respectively connected to the upper ends of the brackets 181 and 182 by pins. The coil springs 185 and 186 are wound round the plungers 189 and 190, respectively. The solenoids 183 and 184 each pulls the respectively plunger 189 or 190 when energized.

The cutting means 120 having the above configuration cuts off the master 9A with the stationary edge 150 and rotary edge 151 respectively contacting the front 9C and back 9D of the master 9A. The cutting means 120 is therefore capable of desirably cutting off the master 9A even when the stencil 9 lacks in elasticity. When the master nipping and conveying means 40 is moved from the first position to the second position respectively indicated by a solid line and a dash-and-dots line in FIG. 14, the solenoids 189 and 190 are energized to shift the cutting means 120 away from the operative position for cutting off the master 9A. This prevents the cutting means 120 from colliding with the clamper 3. In addition, the brackets 181 and 182 supporting both of the stationary edge 150 and rotary edge 151 are movable, so that the positional relation between the two edges 150 and 151 is free from errors which would result in defective cutting.

In the illustrative embodiment, the rotary edge 151 is usually positioned outside of the side edges 9*a* and 9*b* of the master 9A or the side edges 3A and 3B of the clamper 3. Therefore, the master nipping and conveying means 40 does not interfere with the master 9A or the clamper 3 during its movement between the first and second positions. It follows that the cutting means 120 should only slide by a distance allowing the bottoms of the stationary edge 150 and guide rail 144 to reach at least a position where they do not interfere with the edge 3*a* of the clamper 3 held in its open position. If the rotary edge 151 also interferes with the clamper 3, then the above distance should only be so changed as to prevent the circumferential edge of the edge 151 from interfering with the edge 3*a* of the clamper 3. The above advantages are achievable even when the cutting means 120 and cutting means moving means 180 are mounted on the master sucking and conveying means 140 of the second embodiment.

The stationary edge 150 and rotary edge 151 may, of course, be replaced with a pair of rotary edges capable of contacting the opposite sides 9C and 9D of the master 9A, respectively. In such a case, a drive motor or similar drive means will cause the two rotary edges to slide in the widthwise direction Z for cutting off the master 9A.

In the first to third embodiments shown and described, the stencil roll 9R and the clamping position of the in drum 1 are related such that the leading edge 9B of the stencil 9 is conveyed downward toward the clamper 3, as viewed in FIG. 1. This is why the master nipping and conveying means 40 and master sucking and conveying means 140 each is movable in the up-and-down direction, as viewed in FIGS. 1 and 9. Assume that the stencil roll 9R and the clamping position of the ink drum 1 are so related as to convey the leading edge 9B toward the clamper in the horizontal direction. Then, to move the above means 40 or 140 in the right-and-left direction, as viewed in FIGS. 1 or 9, the slots 54 and 55 will be elongate in the right-and-left direction, and the rotary shaft 47 will be rotated to cause the means 40 or 140 to run along the slots 54 and 55. In this case, the rack 51 is not necessary because the shaft 47 plays the role of a drive roller.

In any one of the illustrative embodiments, the master nipping portions 80 and 81 or the master sucking portions 137*b* and 138*b* retain the leading edge 9B of the master 9A. In this condition, the master nipping and conveying means 40 or the master sucking and conveying means 140 conveys the master 9A and causes it to be clamped by the clamper 3 while the master making means 30 continuously perforates the stencil 9. Alternatively, an arrangement may be made such that after the master nipping portions 80 and 81 or the master sucking portions 137*b* and 138*b* have retained the leading edge 9B of the master 9A, the conveying means 40 or 140 conveys the master 9A to the clamper 3 before the perforation of the stencil 9; that is, the stencil 9 may be perforated after the above edge 9B has been clamped by the clamper 3. However, because the length of a single master 9A is limited by the circumferential length of the ink drum 1, it may occur that the perforation area of the master 9A is reduced. To increase the perforation area, i.e., to reduce the non-perforated area of the stencil 9, the movable range of the conveying means 40 or 140 may be reduced, and the clamping position of the ink drum 1 may be brought closer to the first position assigned to the conveying means 40 or 140.

While the stencil 9 has been shown and described as consisting substantially only of a thermoplastic resin film, it may be replaced with a stencil including a porous support formed of Japanese paper or a thin stencil whose support is thinner than the above porous support.

So long as the stencil 9 is little chargeable or used in an environment sparingly charging it, it is not necessary to cut off the master 9A after the master nipping portions 80 and 81 or the master sucking portions 137*b* and 138*b* have retained the leading edge 9B of the master 9A. This is because undesirable wrapping of the master 9A or similar trouble occurs little in the above condition.

In any one of the illustrative embodiments, the cutting means 20 or 120 is mounted on the frame 141 of the conveying means 40 or 140 and moved integrally with the conveying means 40 or 140. Alternatively, the cutting means 20 or 120 may be mounted on, e.g., the frame of the printer body independently of the conveying means 40 or 140. In such a case, the cutting means 20 or 120 will be positioned downstream of the master nipping portions 80 and 81 or the master sucking portions 137*b* and 138*b* in the stencil transport direction X when the conveying means 40 or 140 is held at the first position.

In summary, it will be seen that the present invention provides a printer having various unprecedented advantages, as enumerated below.

(1) A stencil coming out of master making means is prevented from jamming a transport path and can be stably conveyed and handed over to master clamping means mounted on a print drum.

(2) The stencil can be stably retained even when it is electrostatically charged. Because even a stencil easily chargeable can be desirably conveyed, it is possible to reduce the amount of antistatic agent to be applied to the stencil. This reduces the amount of anticorrosion agent and that of antistatic agent to be applied to a thermal head or master making means and thereby reduces the cost of the stencil itself.

(3) The stencil does not stick or curl despite static electricity to deposit on the stencil and can therefore be stably conveyed to the master clamping means without jamming the transport path.

(4) After the stencil has been clamped, it can be desirably cut.

(5) The stencil coming out of the master making means can have its leading edge surely retained and can therefore be prevented from falling during transport.

(6) Master holding portions are movable in the widthwise direction of the stencil while retaining the stencil, preventing the stencil from creasing during transport.

(7) The master holding portions do not interfere with opposite side edges of the stencil.

(8) Master holding means does not interfere with the cutting means.

(9) Even a stencil lacking in elasticity can be desirably cut.

(10) Even when a clamper clamps the leading edge of the stencil on the print drum, the stencil does not crease or slacken. The stencil can therefore be wrapped around the print drum without creasing and insures attractive images free from the influence of creases.

Various modifications will become possible for those skilled in the art after receiving the teachings of the present disclosure without departing from the scope thereof.

What is claimed is:

1. A printer comprising:

a porous rotatable ink drum having master clamping means for clamping a leading edge of a master in a part of an outer periphery thereof;

master making means for perforating a stencil in accordance with image data to thereby produce the master and conveying said master to be wrapped around said ink drum;

cutting means for cutting the stencil perforated by said master making means at a preselected length to thereby separate the master; and master holding means positioned upstream of said cutting means in a direction of master transport, said master holding means including a pair of master holding portions each configured to hold an opposite side edge of the master near to the leading edge, with each of the master holding portions including displacing means for causing said master holding portions to move in a width-wise direction of said master.

2. A printer as claimed in claim 1, further comprising moving means for moving said master holding means toward said master clamping means.

3. A printer as claimed in claim 2, wherein said master holding means is positioned in the vicinity of said master clamping means when said print drum is held at a preselected clamping position for clamping the leading edge of the master.

4. A printer as claimed in claim 3, wherein said moving means moves said master holding means back and forth between a first position upstream of said cutting means in the direction of stencil transport for holding the leading edge of the master and a second position where said leading edge of said master is moved past a clamping portion of said master clamping means to be clamped by said clamping means.

5. A printer as claimed in claim 4, further comprising control means for driving a drive section included in said cutting means when said master holding means is in said first position and when the master is conveyed by said master making means by a preselected amount.

6. A printer as claimed in claim 2, wherein said moving means moves said master holding means back and forth between a first position upstream of said cutting means in the direction of stencil transport for holding the leading edge of the master and a second position where said leading edge of said master is moved past a clamping portion of said master clamping means to be clamped by said clamping means.

7. A printer as claimed in claim 6, wherein said master clamping means comprises a clamper mounted on the outer periphery of said ink drum and clamper drive means for causing said clamper to selectively open or close, said clamper having opposite side edges thereof in a widthwise direction of the master notched in order to accommodate said pair of master holding portions.

8. A printer as claimed in claim 7, wherein said pair of master holding portions each comprises a master nipping portion selectively closed to nip one of opposite side edges of the master from a front and a back of said master, and nipping portion drive means for causing said master nipping portion to open or close.

9. A printer as claimed in claim 8, further comprising control means for controlling an operation of said nipping portion drive means such that master nipping portions of said pair of master holding portions close when said master holding means is in said first position or open when said master holding means is in said second position, and controlling an operation of said clamper drive means such that said clamper closes before said master nipping portions open at said second position.

10. A printer as claimed in claim 9, wherein said displacing means includes a displacing means drive mechanism for causing said master nipping portions to move between respective operative position for holding opposite side edges of a leading edge of the master, and respective inoperative positions outward of said side edges.

11. A printer as claimed in claim 10, wherein said control means controls, after a closing of said clamper, an operation of a drive section included in said displacing means drive mechanism such that said master nipping portions move from said operative positions to said inoperative positions, controls, when said master nipping portions reach said inoperative positions, the operation of said drive section such that said master holding means moves to said first position, and controls, when said master holding means reaches said first position, the operation of said drive section such that said master nipping portions move from said inoperative positions to said operative positions.

12. A printer as claimed in claim 11, wherein said inoperative positions are outward of said clamper held in an open position in an opening direction of said clamper or outside of the side edges of the clamper.

13. A printer as claimed in claim 6, further comprising control means for driving a drive section included in said cutting means when said master holding means is in said first position and when the master is conveyed by said master making means by a preselected amount.

14. A printer as claimed in claim 2, wherein said master holding means is capable of moving via a cutting position where said cutting means cuts the stencil.

15. A printer as claimed in claim 14, wherein said cutting means is mounted on said master holding means.

16. A printer as claimed in claim 15, further comprising cutting means moving means for moving, when said cutting means approaches said master clamping means, said cutting means to a position where said cutting means does not interfere with said master clamping means.

17. A printer as claimed in claim 2, further comprising tension applying means for applying tension to the master held by said master holding means and moving toward said master clamping means.

18. A printer comprising:

a porous rotatable ink drum having master clamping means for clamping a leading edge of a master in a part of an outer periphery thereof;

master making means for perforating a stencil in accordance with image data to thereby produce the master and conveying said master to be wrapped around said ink drum;

cutting means for cutting the stencil perforated by said master making means at a preselected length to thereby separate the master; and master holding means including a pair of master holding portions positioned upstream of said cutting means in a direction of master transport for holding the master, wherein said master clamping means comprises a clamper mounted on the outer periphery of said ink drum and clamper drive means for causing said clamper to selectively open or close, said clamper having opposite side edges thereof in a widthwise direction of the master notched in order to accommodate said pair of master holding portions.

19. A printer as claimed in claim 18, wherein said pair of master holding portions each comprises a master nipping portion selectively closed to nip one of opposite side edges of the master from a front and a back of said master, and nipping portion drive means for causing said master nipping portion to open or close.

20. A printer as claimed in claim 19, further comprising control means for controlling an operation of said nipping portion drive means such that master nipping portions of said pair of master holding portions close when said master holding means is in said first position or open when said master holding means is in said second position, and controlling an operation of said clamper drive means such that said clamper closes before said master nipping portions open at said second position.

21. A printer as claimed in claim 20, further comprising displacing means for causing said master nipping portions to move in a widthwise direction of the master.

22. A printer as claimed in claim 21, wherein said displacing means includes a displacing means drive mechanism for causing said master nipping portions to move between respective operative position for holding opposite side edges of a leading edge of the master, and respective inoperative positions outward of said side edges.

23. A printer as claimed in claim 22, wherein said control means controls, after a closing of said clamper, an operation of a drive section included in said displacing means drive mechanism such that said master nipping portions move from said operative positions to said inoperative positions, controls, when said master nipping portions reach said inoperative positions, the operation of said drive section such that said master holding means moves to said first position, and controls, when said master holding means reaches said first position, the operation of said drive section such that said master nipping portions move from said inoperative positions to said operative positions.

24. A printer as claimed in claim 23, wherein said inoperative positions are outward of said clamper held in an open position in an opening direction of said clamper or outside of the side edges of the clamper.

25. A printer comprising:

a porous rotatable ink drum having master clamping means for clamping a leading edge of a master in a part of an outer periphery thereof;

master making means for perforating a stencil in accordance with image data to thereby produce the master and conveying said master to be wrapped around said ink drum;

cutting means for cutting the stencil perforated by said master making means at a preselected length to thereby separate the master; and master holding means for holding the master before said cutting means cuts the stencil, wherein said master holding means comprises a pair of master holding portions for respectively holding opposite side edges near to the leading edge, with each of the master holding portions including displacing means for causing said master holding portions to move in a width-wise direction of said master.

26. A printer as claimed in claim 25, further comprising moving means for moving said master holding means toward said master clamping means.

27. A printer as claimed in claim 26, wherein said master holding means is positioned in the vicinity of said master clamping means when said print drum is held at a preselected clamping position for clamping the leading edge of the master.

28. A printer as claimed in claim 27, wherein said moving means moves said master holding means back and forth between a first position upstream of said cutting means in the direction of stencil transport for holding the leading edge of the master and a second position where said leading edge of said master is moved past a clamping portion of said master clamping means to be clamped by said clamping means.

29. A printer as claimed in claim 28, wherein said master clamping means comprises a clamper openably mounted on the outer periphery of said ink drum and clamper drive means for causing said clamper to selectively open or close, said clamper having opposite side edges thereof in a widthwise direction of the master notched in order to accommodate said pair of master holding portions.

30. A printer as claimed in claim 29, wherein said pair of master holding portions each comprises a master nipping portion selectively closed to nip one of opposite side edges of the master from a front and a back of said master, and nipping portion drive means for causing said master nipping portion to open or close.

31. A printer as claimed in claim 30, further comprising control means for controlling an operation of said nipping portion drive means such that master nipping portions of said pair of master holding portions close when said master holding means is in said first position or open when said master holding means is in said second position, and controlling an operation of said clamper drive means such that said clamper closes before said master nipping portions open at said second position.

32. A printer as claimed in claim 31, wherein said displacing means includes a displacing means drive mechanism for causing said master nipping portions to move between respective operative position for holding opposite side edges of a leading edge of the master and respective inoperative positions outward of said side edges.

33. A printer as claimed in claim 32, wherein said control means controls, after a closing of said clamper, an operation of a drive section included in said displacing means drive mechanism such that said master nipping portions move from said operative positions to said inoperative positions, controls, when said master nipping portions reach said inoperative positions, the operation of said drive section such that said master holding means moves to said first position, and controls, when said master holding means reaches said first position, the operation of said drive section such that said master nipping portions move from said inoperative positions to said operative positions.

34. A printer as claimed in claim 33, wherein said inoperative positions are outward of said clamper held in an open position in an opening direction of said clamper or outside of the side edges of the clamper.

35. A printer as claimed in claim 28, further comprising control means for driving a drive section included in said cutting means when said master holding means is in said first position and when the master is conveyed by said master making means by a preselected amount.

36. A printer as claimed in claim 26, wherein said moving means moves said master holding means back and forth between a first position upstream of said cutting means in the direction of stencil transport for holding the leading edge of the master and a second position where said leading edge of said master is moved past a clamping portion of said master clamping means to be clamped by said clamping means.

37. A printer as claimed in claim 36, further comprising control means for driving a drive section included in said cutting means when said master holding means is in said first position and when the master is conveyed by said master making means by a preselected amount.

38. A printer as claimed in claim 26, wherein said master holding means is capable of moving via a cutting position where said cutting means cuts the stencil.

39. A printer as claimed in claim 38, wherein said cutting means is mounted on said master holding means.

40. A printer as claimed in claim 39, further comprising cutting means moving means for moving, when said cutting means approaches said master clamping means, said cutting means to a position where said cutting means does not interfere with said master clamping means.

41. A printer as claimed in claim 26, further comprising tension applying means for applying tension to the master held by said master holding means and moving toward said master clamping means.

42. A printer comprising:

a porous rotatable ink drum having master clamping means for clamping a leading edge of a master in a part of an outer periphery thereof;

master making means for perforating a stencil in accordance with image data to thereby produce the master and conveying said master to be wrapped around said ink drum;

cutting means for cutting the stencil perforated by said master making means at a preselected length to thereby separate the master; and master holding means for holding the master before said cutting means cuts the stencil, said master holding means including a pair of master holding portions, wherein said master clamping means comprises a clamper mounted on the outer periphery of said ink drum and clamper drive means for causing said clamper to selectively open or close, said clamper having opposite side edges thereof in a widthwise direction of the master notched in order to accommodate said pair of master holding portions.

43. A printer as claimed in claim 42, wherein said pair of master holding portions each comprises a master nipping portion selectively closed to nip one of opposite side edges of the master from a front and a back of said master, and nipping portion drive means for causing said master nipping portion to open or close.

44. A printer as claimed in claim 43, further comprising control means for controlling an operation of said nipping portion drive means such that master nipping portions of said pair of master holding portions close when said master holding means is in said first position or open when said master holding means is in said second position, and controlling an operation of said clamper drive means such that said clamper closes before said master nipping portions open at said second position.

45. A printer as claimed in claim 44, further comprising displacing means for causing said master nipping portions to move in a widthwise direction of the master.

46. A printer as claimed in claim 45, wherein said displacing means includes a displacing means drive mechanism for causing said master nipping portions to move between respective operative position for holding opposite side edges of a leading edge of the master, and respective inoperative positions outward of said side edges.

47. A printer as claimed in claim 46, wherein said control means controls, after a closing of said clamper, an operation of a drive section included in said displacing means drive mechanism such that said master nipping portions move from said operative positions to said inoperative positions, controls, when said master nipping portions reach said inoperative positions, the operation of said drive section such that said master holding means moves to said first position, and controls, when said master holding means reaches said first position, the operation of said drive section such that said master nipping portions move from said inoperative positions to said operative positions.

48. A printer as claimed in claim 47, wherein said inoperative positions are outward of said clamper held in an open position in an opening direction of said clamper or outside of the side edges of the clamper.

* * * * *

UNITED STATES PATENT AND TRADEMARK OFFICE

CERTIFICATE OF CORRECTION

PATENT NO. : 6,230,617 B1
DATED : May 15, 2001
INVENTOR(S) : Tomiya Mori

It is certified that error appears in the above-identified patent and that said Letters Patent is hereby corrected as shown below:

Column 4,
Line 35, insert -- of -- between "role" and "a";
Line 55, delete "mater" and insert in its place -- master --.

Column 6,
Line 13, delete "a real so" and insert in its place -- are also --;
Line 14, add -- . -- after "means";
Line 29, delete "270" and insert in its place -- 27C --;
Line 52, delete "270" and insert in its place -- 27C --.

Column 10,
Line 42, insert a space between "drum" and "1".

Column 13,
Line 2, delete "90" and insert in its place -- 9C --.

Column 17,
Line 45, delete "maser" and insert -- master -- in its place.

Signed and Sealed this

Thirtieth Day of April, 2002

*Attest:*

*Attesting Officer*

JAMES E. ROGAN
*Director of the United States Patent and Trademark Office*